US007825754B2

(12) United States Patent
Kawai et al.

(10) Patent No.: US 7,825,754 B2
(45) Date of Patent: Nov. 2, 2010

(54) VARIABLE RESONATOR

(75) Inventors: Kunihiro Kawai, Yokohama (JP); Atsushi Fukuda, Yokohama (JP); Hiroshi Okazaki, Yokosuka (JP); Shoichi Narahashi, Yokohama (JP)

(73) Assignee: NTT DoCoMo, Inc., Tokyo (JP)

( * ) Notice: Subject to any disclaimer, the term of this patent is extended or adjusted under 35 U.S.C. 154(b) by 707 days.

(21) Appl. No.: 11/555,437

(22) Filed: Nov. 1, 2006

(65) Prior Publication Data

US 2007/0103261 A1 May 10, 2007

(30) Foreign Application Priority Data

Nov. 8, 2005 (JP) ..... 2005-323451

(51) Int. Cl.
*H01P 7/08* (2006.01)
*H01P 1/203* (2006.01)

(52) U.S. Cl. ..... 333/235; 333/205

(58) Field of Classification Search ..... 333/32, 333/33, 202, 204, 205, 219, 236, 238, 22 R, 333/140, 161, 164, 246, 263, 101, 103, 104, 333/105

See application file for complete search history.

(56) References Cited

U.S. PATENT DOCUMENTS 5,808,527 A * 9/1998 De Los Santos ..... 333/205
6,043,727 A 3/2000 Warneke et al.
6,259,332 B1 * 7/2001 Hosoya ..... 331/96
6,452,465 B1 * 9/2002 Brown et al. ..... 333/205
6,472,953 B1 10/2002 Sakuragawa et al.
6,552,626 B2 4/2003 Sharpe et al.
7,382,213 B2 * 6/2008 Yang et al. ..... 333/33
2005/0190018 A1 9/2005 Kawai et al.

(Continued)

FOREIGN PATENT DOCUMENTS

EP 0 849 820 A2 6/1998

(Continued)

OTHER PUBLICATIONS

G. Matthaei, et al., "Band-Pass Filters With Wide Stop Bands[16]", Artech House, 1980, pp. 486-497.

(Continued)

*Primary Examiner*—Benny Lee
*Assistant Examiner*—Gerald Stevens
(74) *Attorney, Agent, or Firm*—Oblon, Spivak, McClelland, Maier & Neustadt, L.L.P.

(57) ABSTRACT

A variable resonator has a dielectric substrate 2, an input/output line 3 formed on the dielectric substrate 2, a first resonator 4 that has one end connected to the input/output line 3 and the other end grounded, and a second resonator that has one end connected to the input/output line 3 at the point of connection of the one end of the first resonator 4 and the other end grounded via a terminal switch 7. When the terminal switch 7 is turned off, resonance occurs at a frequency at which the sum of the line lengths of the first resonator 4 and the second resonator 6 equals to a quarter of the wavelength. When the terminal switch 7 is turned on, resonance occurs at a frequency at which a half of the sum of the line lengths equals to a quarter of the wavelength.

11 Claims, 19 Drawing Sheets

U.S. PATENT DOCUMENTS

| | | | |
|---|---|---|---|
| 2006/0087388 | A1 | 4/2006 | Kawai et al. |
| 2006/0202764 | A1 | 9/2006 | Fukuda et al. |

FOREIGN PATENT DOCUMENTS

| | | |
|---|---|---|
| JP | 01-200726 | 8/1989 |
| JP | 8-307106 | 11/1996 |
| JP | 2000-101380 | 4/2000 |
| JP | 2002-335109 | 11/2002 |
| JP | 2003-023304 | 1/2003 |
| JP | 2005-253059 | 9/2005 |

OTHER PUBLICATIONS

Kunihiro Kawai, et al., "Tunable Resonator Employing Comb-Shaped Transmission Line and Switches," 35th European Mircowave Conference, Oct. 2005, pp. 193-196.

Kunihiro Kawai, et al., "Comb-shaped transmission Line Tunable Resonator," Wireless Laboratories, NTT DoCoMo, Inc., C-2-39, 2005, p. 72 (4 pages).

Kunihiro Kawai, et al., "Tunable Band-pass Filter Employing Comb-shaped Transmission Line Resonator," Wireless Laboratories, NTT DoCoMo, Inc., C-2-39, 2005, p. 58 (3 pages).

* cited by examiner

FIG. 3A VERTICALLY SYMMETRIC RESONATOR WHEN SW IS OFF

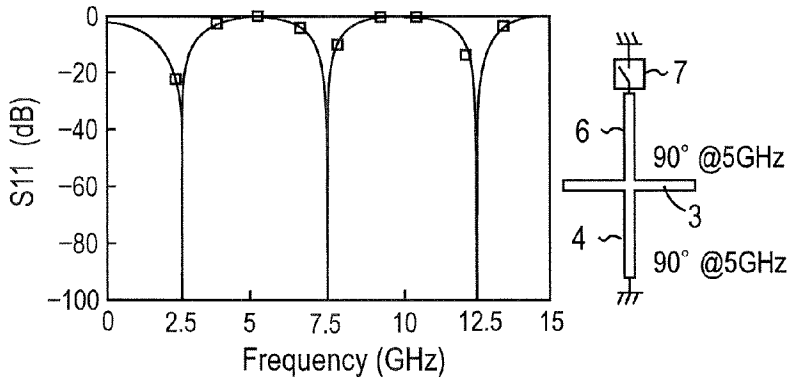

FIG. 3B VERTICALLY SYMMETRIC RESONATOR WHEN SW IS ON

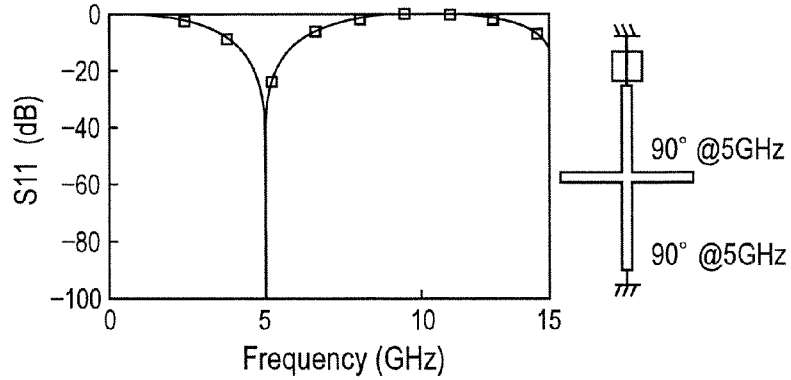

FIG. 3C

| LINE LENGTH | | FREQUENCY | EFFECTIVE LINE LENGTH βL | | | COMBINED ADMITTANCE | |
|---|---|---|---|---|---|---|---|
| | | | | | | SWITCH OFF | SWITCH ON |
| La | Lb | (GHz) | $\frac{2\pi}{\lambda} \cdot La(b)$ | $\tan\beta L$ | $\cot\beta L$ | $Y_2 = jY_0(\tan\beta L - \cot\beta L)$ | $Y_1 = 2jY_0 \cot\beta L$ |
| $\frac{\lambda_{5G}}{4}$ | $\frac{\lambda_{5G}}{4}$ | 2.5 | 45° | 1 | 1 | 0 | $-2jY_0$ |
| | | 5.0 | 90° | ∞ | 0 | ∞ | 0 |
| | | 7.5 | 135° | −1 | −1 | 0 | $2jY_0$ |
| | | 10.0 | 180° | 0 | ∞ | ∞ | ∞ |
| | | 12.5 | 225° | 1 | 1 | 0 | $-2jY_0$ |
| | | 15.0 | 270° | ∞ | 0 | ∞ | 0 |

FIG. 4A VERTICALLY ASYMMETRIC RESONATOR WHEN SW IS OFF

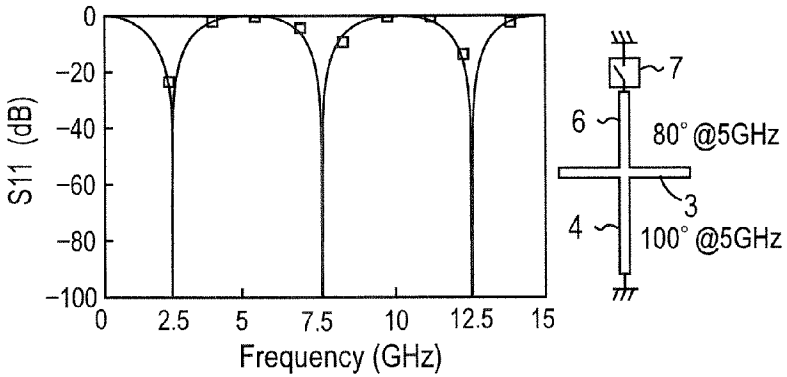

FIG. 4B VERTICALLY ASYMMETRIC RESONATOR WHEN SW IS ON

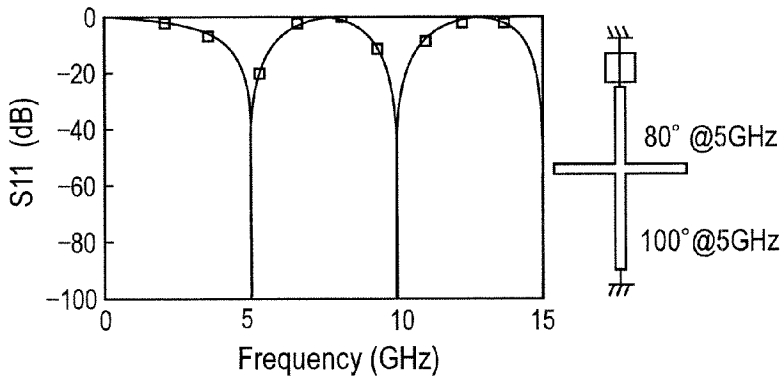

FIG. 4C

| LINE LENGTH | | FREQ | EFFECTIVE LINE LENGTH | | | | | | COMBINED ADMITTANCE | |
|---|---|---|---|---|---|---|---|---|---|---|
| | | | | | | | | | SWITCH OFF | SWITCH ON |
| La | Lb | (GHz) | $\beta$ La | $\beta$ Lb | tan $\beta$ La | cot $\beta$ La | tan $\beta$ Lb | cot $\beta$ Lb | tan $\beta$ Lb − cot $\beta$ La | cot $\beta$ La + cot $\beta$ Lb |
| $\frac{5\lambda_{5G}}{18}$ | $\frac{2\lambda_{5G}}{9}$ | 2.5 | 50° | 40° | 1.19 | 0.83 | 0.83 | 1.19 | 0 | 2.02 |
| | | 5.0 | 100° | 80° | −5.67 | −0.17 | 5.67 | 0.17 | 5.84 | 0 |
| | | 7.5 | 150° | 120° | −0.57 | −1.73 | −1.73 | −0.57 | 0 | −2.3 |
| | | 10.0 | 200° | 160° | 0.36 | 2.74 | −0.36 | −2.74 | 3.1 | 0 |
| | | 12.5 | 250° | 200° | 2.74 | 0.36 | 0.36 | 2.74 | 0 | 3.1 |
| | | 15.0 | 300° | 240° | −1.73 | −0.57 | 1.73 | 0.57 | 2.3 | 0 |

FIG. 5A VERTICALLY ASYMMETRIC RESONATOR WHEN SW IS OFF

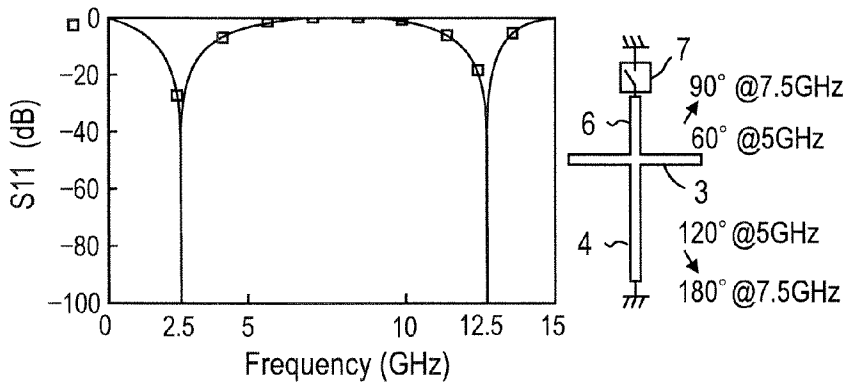

FIG. 5B VERTICALLY ASYMMETRIC RESONATOR WHEN SW IS ON

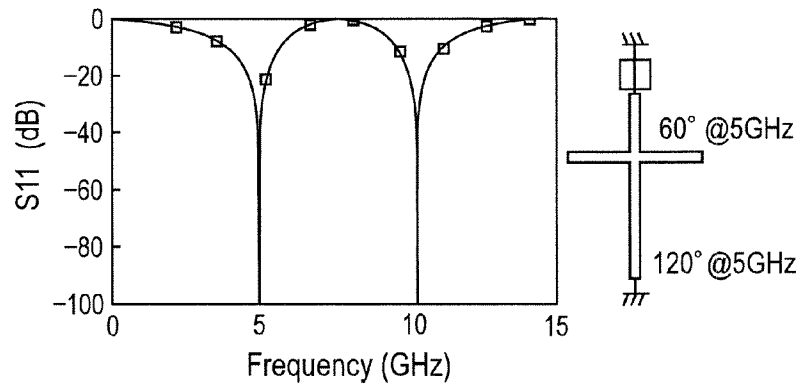

FIG. 5C

| LINE LENGTH | | FREQ (GHz) | EFFECTIVE LINE LENGTH | | | | | | COMBINED ADMITTANCE | |
|---|---|---|---|---|---|---|---|---|---|---|
| | | | | | | | | | SWITCH OFF | SWITCH ON |
| La | Lb | | $\beta$ La | $\beta$ Lb | tan $\beta$ La | cot $\beta$ La | tan $\beta$ Lb | cot $\beta$ Lb | tan $\beta$ Lb − cot $\beta$ La | cot $\beta$ La + cot $\beta$ Lb |
| $\frac{\lambda_{5G}}{3}$ | $\frac{\lambda_{5G}}{6}$ | 2.5 | 60° | 30° | 1.73 | 0.57 | 0.57 | 1.73 | 0 | 2.3 |
| | | 5.0 | 120° | 60° | −1.73 | −0.57 | 1.73 | 0.57 | 5.84 | 0 |
| | | 7.5 | 180° | 90° | 0 | −∞ | −∞ | 0 | INDETERMINATE | −∞ |
| | | 10.0 | 240° | 120° | 1.73 | 0.57 | −1.73 | −0.57 | −2.3 | 0 |
| | | 12.5 | 300° | 150° | −1.73 | −0.57 | −0.57 | −1.73 | 0 | −2.3 |
| | | 15.0 | 360° | 180° | 0 | ∞ | 0 | ∞ | −∞ | INDETERMINATE |

VARIABLE RESONATOR

TECHNICAL FIELD

The present invention relates to a line-type variable resonator that is mounted on a radio communications device, for example, and constitutes a filter or the like. In particular, it relates to a variable resonator that has a wide range of variable frequency and a low loss.

BACKGROUND ART

In the field of radio communications using high-frequency signals, required signals are separated from unnecessary signals by extracting signals of a particular frequency from a great amount of signals. The circuit that serves this function is generally referred to as filter and is mounted on many radio communications devices. A resonator of the filter that has a line structure is required to have a line length equal to about a quarter or a half of the wavelength at the resonance frequency. In addition, main design parameters of the resonator, such as the center frequency and the bandwidth, are fixed. As for the case where a radio communications device uses two frequency bands, the patent literature 1 by the present applicants discloses an exemplary device that has two resonators different in center frequency and bandwidth and a switch to switch between using one of the resonators and using the two resonators connected in series to each other.

In the variable resonator disclosed in the patent literature 1, as shown in FIG. 22, a first resonator 222 and a second resonator 223 are connected in series to each other via a switch 224 interposed therebetween on a surface of a dielectric substrate 220.

The first resonator 222 has a first line 225 having a length of L1 and second lines 226*a*, 226*b*, 227*a*, 227*b*, 228*a*, 228*b*, 229*a* and 229*b* having the same width W as the first line 225 and a length of Δh that are connected to the first line 225 and arranged at regular intervals ΔL on either side of the first line 225.

One end of the first line 225 extends for a length of L 3 to the direction away from the second lines 226*a* and 226*b* and is connected to a high-frequency signal input/output line 221 that extends in a direction perpendicular to the direction in which the first line 225 extends.

At the other end of the first line 225 opposite to the input/output line 221, a first line 270 of the second resonator 223 is disposed with the switch 224 interposed therebetween. The first line 270 has a length of L 2, and the end of the first line 270 opposite from the switch 224 is grounded. The first line 270 of the second resonator 223 also has second lines 230*a*, 230*b* to 233*a*, 233*b* arranged on either side thereof (four on each side) at regular intervals and connected thereto.

Line short-circuiting switches 250*a*, 250*b* to 255*a*, 255*b* are connected between free ends of adjacent second lines of the first resonator 222 and the second resonator 223. For example, the line short-circuiting switch 250*a* is connected between the free ends of the second lines 226*a* and 227*a* of the first resonator 222, and the line short-circuiting switch 250*b* is connected between the free ends of the second lines 226*b* and 227*b*. In other words, six line short-circuiting switches 250*a*, 250*b* to 252*a*, 252*b* are disposed symmetrically with respect to the first line 255 (three on each side of the first line 255).

Similarly, the second resonator 223 also has six line short-circuiting switches 253*a*, 253*b* to 255*a*, 255*b* connected between free ends of the second lines (three on each side of the first line). The line short-circuiting switches 250*a*, 250*b* to 255*a*, 255*b* are intended to change the effective line length (current path length, hereinafter referred to simply as path length) of the resonators using the property of the high-frequency current of flowing near the outer surface of a conductor (skin effect, described in detail later). If the line short-circuiting switch 250*a* connected between the second lines 226*a* and 227*a* is closed, the effective line length is reduced by 2Δh. Although not shown, a ground conductor is formed on the back surface of the dielectric substrate 220 at least over the regions opposing the input/output line 221, the first resonator 222 and the second resonator 223 to constitute a microstrip line structure.

A method of changing the resonance frequency of the first resonator 222 will be described. To minimize the resonance frequency of the first resonator 222, all the line short-circuiting switches 250*a*, 250*b* to 252*a*, 252*b* are opened (turned off). To slightly raise the resonance frequency from this minimum resonance frequency, one of the pairs of line short-circuiting switches 250*a*, 250*b* to 252*a*, 252*b* is closed (turned on). Then, compared with the line length in the case where all the line short-circuiting switches 250*a*, 250*b* to 252*a*, 252*b* are opened, the line length is reduced by 2Δh, and the resonance frequency is increased accordingly.

On the other hand, to further reduce the resonance frequency of the variable resonator from the minimum resonance frequency of the first resonator 222, the switch 224 is closed to connect the second resonator 223 to the first resonator 222 in series. With this arrangement, compared with the case where the first resonator 222 is used alone, the line length is elongated, so that the resonance frequency is reduced.

Patent literature 1: Japanese Patent Application Laid-Open No. 2005-253059 (FIG. 7)

DISCLOSURE OF THE INVENTION

Problem to be Solved by the Invention

However, the prior art described above has a problem that, when reducing the resonance frequency to below the resonance frequency of the first resonator 222, the resonators are connected to each other by the switch 224, so that the resistance of the switch 224 is inserted in series to the resonators, and the loss of the variable resonator increases. In other words, the prior art is based only on the idea that the switch is used to elongate the line length in one direction, thereby expanding the range of variation of frequency of the resonator. The resistance of the switch used to interconnect the resonators becomes a cause of the loss increase.

The present invention has been devised in view of such circumstances, and an object of the present invention is to provide a variable resonator that can change the resonance frequency over a wide range and has a low loss.

Means To Solve Problem

According to the present invention, one end of a first resonator is connected to an input/output line formed on a dielectric substrate, the other end of the first resonator is grounded, one end of a second resonator is connected to the point of connection of the first resonator to the input/output line, and the other end of the second resonator is grounded via a terminal switch.

Effects Of The Invention

As described above, according to the present invention, the first resonator and the second resonator are connected in parallel to the input/output line. When the terminal switch is turned off, resonance occurs at a frequency at which the sum of the lengths (electrical lengths) of the resonance lines of the first and second resonators equals to a quarter of the wavelength. When the terminal switch is turned on, resonance occurs at a frequency at which a half of the sum equals to a quarter of the wavelength. Since the resistance of the terminal switch for changing the resonance frequency is connected in parallel, the effect of the resistance of the switch can be reduced compared with the prior art, and there can be provided a variable resonator that has a wide range of variation of frequency and a low loss.

BRIEF DESCRIPTION OF THE DRAWINGS

FIG. 3A is a diagram showing a frequency characteristic of a variable resonator according to the present invention at the time when a terminal switch thereof is turned off;

FIG. 3B is a diagram showing a frequency characteristic of the variable resonator at the time when the terminal switch is turned on;

FIG. 3C is a table that summarizes resonance frequencies;

FIG. 4A is a diagram showing a frequency characteristic of a variable resonator according to the present invention at the time when a terminal switch thereof is turned off;

FIG. 4B is a diagram showing a frequency characteristic of the variable resonator at the time when the terminal switch is turned on;

FIG. 4C is a table that summarizes resonance frequencies;

FIG. 5A is a diagram showing a frequency characteristic of a variable resonator according to the present invention at the time when a terminal switch thereof is turned off;

FIG. 5B is a diagram showing a frequency characteristic of the variable resonator at the time when the terminal switch is turned on;

FIG. 5C is a table that summarizes resonance frequencies;

BEST MODES FOR CARRYING OUT THE INVENTION

Figure 1B:
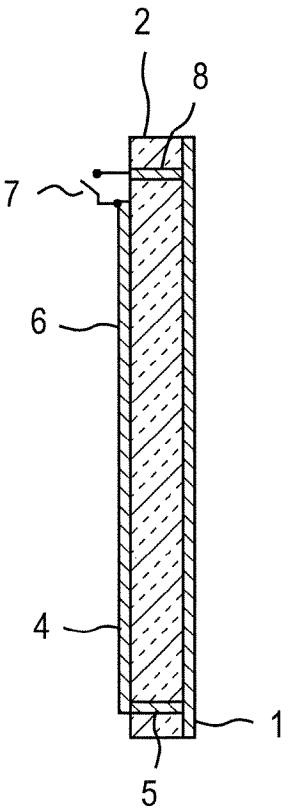
FIG. 1B is a cross-sectional view taken along the line 1B-1B in FIG. 1A.

In the following, embodiments of the present invention will be described with reference to the drawings. In the following description, the same parts are designated by the same reference numerals, and redundant description will be omitted.

FIRST EMBODIMENT

Figure 1A:
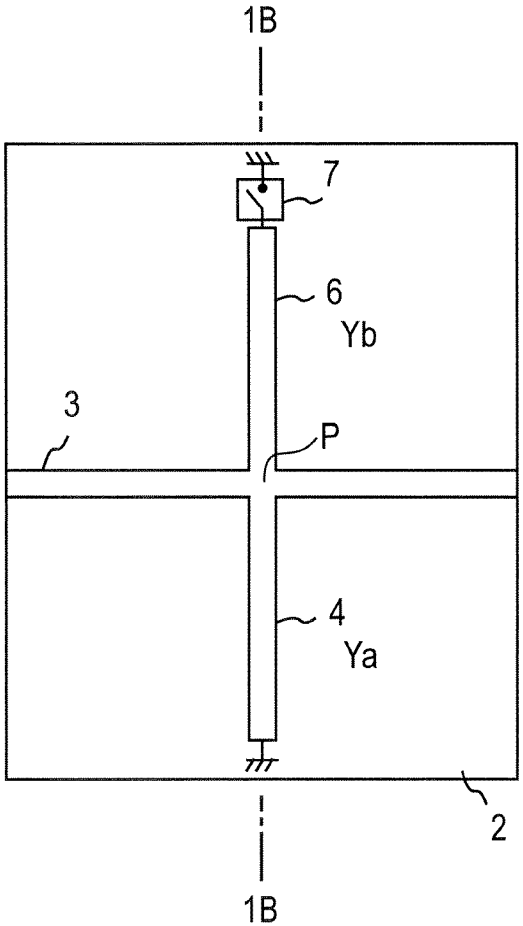
FIG. 1A is a plan view of a variable resonator having a microstrip line structure according to the present invention.

FIG. 1 shows a resonator having a microstrip line structure according to the present invention. FIG. 1A is a plan view, and FIG. 1B is a cross-sectional view taken along the line 1B-1B in FIG. 1A. An input/output line 3 is formed on the front surface of a dielectric substrate 2, and the back surface of the dielectric substrate 2 is grounded via a ground conductor 1. A high-frequency signal is input to one end of the input/output line 3. In this example, a first resonator 4 is connected to the input/output line 3 at one end thereof, extends in a direction perpendicular to the input/output line 3 and is grounded to the ground conductor 1 at the other end via a conductor passing through an interlayer connection (referred to as via hole hereinafter) 5. The characteristic impedance of the first resonator 4 is $Z_0$.

One end of a second resonator 6 is connected to the input/output line 3 at the point of connection of the one end of the first resonator 4 to the input/output line 3. The second resonator 6 extends on the side of the input/output line 3 opposite from the first resonator 4 and the other end of the second resonator 6 is grounded to the ground conductor 1 via a terminal switch 7 and a via hole 8. The characteristic impedance and line length of the second resonator 6 are equal to those of the first resonator 4.

It is assumed that the terminal switch 7 is an ideal one, that is, the resistance thereof is 0 when the switch is closed (turned on) and infinite when the switch is opened (turned off). Provided that the admittance of the first resonator 4 is Ya, and the admittance of the second resonator 6 is Yb, because the two resonators have an equal characteristic impedance of $Z_0$, the admittances Ya and Yb at the time when the terminal switch 7 is closed can be expressed by the following equation (1).

$$Ya=Yb=-jY_0\cdot\cot\beta L \tag{1}$$

In this equation, β denotes a phase constant (β=2π/λ), λ denotes a wavelength, and $Y_0=1/Z_0$.

The combined admittance Y1 at the point of connection P of the first resonator 4 and the second resonator 6 shown in FIG. 1A can be expressed by the following equation (2).

$$Y1=Ya+Yb=-2jY_0\cdot\cot\beta L \tag{2}$$

In a state of resonance, the combined admittance Y1 equals to 0 (Y1=0), and thus, the value β that satisfies this condition is determined as expressed by the following equation (3).

$$\beta=\pi/2L \tag{3}$$

At this time, the effective line length L is λ/4 (L=λ/4). Thus, the resonance frequency at the time when the terminal switch 7 is closed is a frequency at which a quarter of the wavelength equals to L (L=λ/4). The resonance frequency described here means a parallel resonance frequency for which the admittance equals to 0, that is, the impedance is infinite.

On the other hand, in the case where the terminal switch 7 is opened, the admittance Ya of the first resonator 4 is expressed by the following equation (4), and the admittance Yb of the second resonator 6 is expressed by the following equation (5).

$$Ya=-jY_0\cdot\cot\beta L \tag{4}$$

$$Yb=jY_0\cdot\tan\beta L \tag{5}$$

Thus, the combined admittance Y2 at the point of connection P can be expressed by the following equation (6).

$$Y2=Ya+Yb=jY_0(\tan\beta L-\cot\beta L) \tag{6}$$

In a state of resonance, the combined admittance Y2 equals to 0 (Y2=0), and thus, the value β that satisfies this condition is determined as expressed by the following equation (7).

$$\beta=\pi/4L \tag{7}$$

At this time, since β=2π/λ, 2L=λ/4. Thus, resonance occurs at a frequency at which a quarter of the wavelength equals to 2L, that is, a frequency equal to a half of the resonance frequency at the time when the terminal switch 7 is closed described above.

As described above, the resonance frequency of the variable resonator shown in FIGS. 1A and 1B can be changed by a factor of 2 by turning on and off the terminal switch 7. According to the present invention, the resonance frequency of the variable resonator is determined by the sum of the effective electrical lengths (referred to simply as electrical length) of the first resonator 4 and the second resonator 6 when the terminal switch 7 is turned off, and determined by a half of the sum of the electrical lengths when the terminal switch 7 is turned on. In this way, the resonance frequency can be changed greatly.

Next, the low loss, which is a characteristic of the present invention, will be described with reference to FIG. 2. FIG. 2A shows an exemplary variable resonator according to the prior art that has the same resonance frequency as the variable resonator according to the present invention shown in FIG. 1A.

The variable resonator shown in FIG. 2A comprises an input/output line 20, a low-frequency resonator 21 that has one end connected to the input/output line 20 at about the middle of the input/output line 20, extends for a length of L1 in a direction perpendicular to the input/output line 20 and is grounded at the other end, and a high-frequency resonator switch 22 that grounds the low-frequency resonator 21 at a point at a distance L2, shorter than L1, from the one end thereof.

The on and off states of the high-frequency resonator switch 22 correspond to the on and off states of the terminal switch 7 shown in FIG. 1A described above. In other words, the variable resonator is designed so that the line length of the resonator changes to L2, which is a half of L1, when the high-frequency resonator switch 22 is turned on, and the frequency is equal to that of the variable resonator shown in FIG. 1A.

Figure 2B:
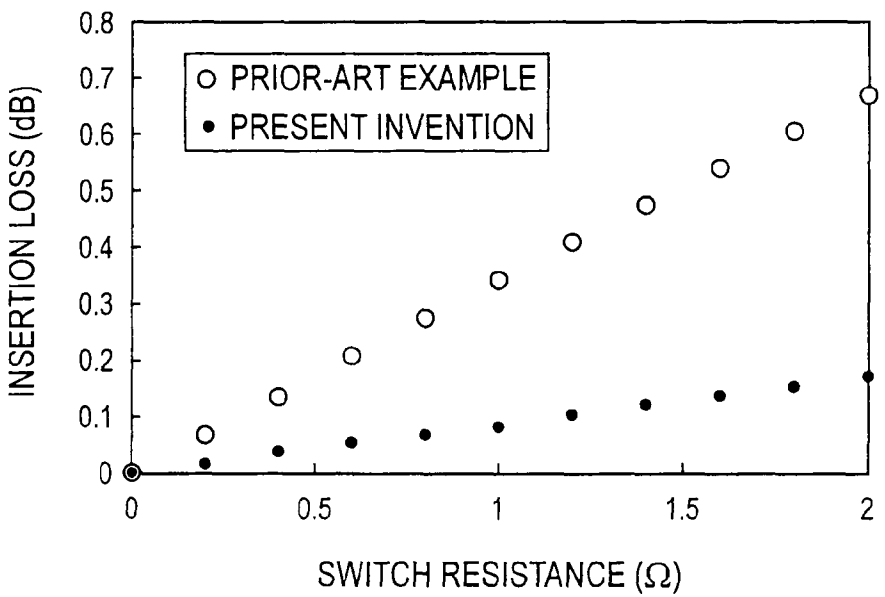
FIG. 2B is a graph for illustrating a comparison in insertion loss.
Figure 2A:
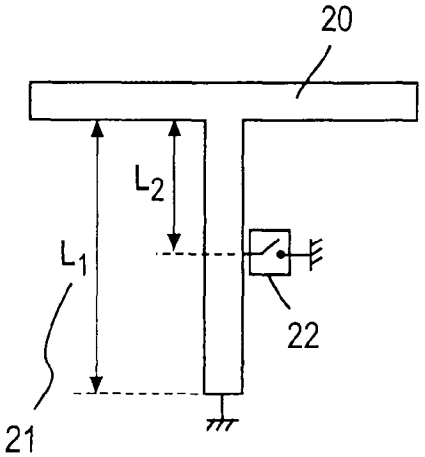
FIG. 2A PRIOR ART
FIG. 2A is a plan view of a prior-art variable resonator for illustrating the difference in insertion loss between the variable resonator according to the present invention and the prior-art variable resonator.

FIG. 2B shows a result of comparison of insertion loss between the variable resonator according to the present invention and the prior-art variable resonator based on this assumption. In FIG. 2B, the abscissa axis indicates the resistance of the terminal switch 7 and the high-frequency resonator switch 22, and the ordinate axis indicates the insertion loss in dB. The black dots represent the insertion loss of the variable resonator according to the present invention, and the white dots represent the insertion loss of the prior-art variable resonator.

As the on resistance of the switch increases, the insertion loss increases. The slope of the insertion loss with respect to the on resistance of the switch of the prior-art variable resonator is about 0.35 dB/Ω, which is about three times greater than that of the variable resonator according to the present invention. From the comparison at the point where the on resistance equals to 1Ω, it can be seen that the insertion loss of the prior-art variable resonator is 0.35 dB, which is higher than the insertion loss of 0.1 dB of the variable resonator according to the present invention.

This is because the first and second resonators of the variable resonator according to the present invention are connected in parallel with each other. In the prior-art variable resonator shown in FIG. 2A, when the high-frequency resonator switch 22 is turned on, the part of the low-frequency resonator 21 extending from the point of connection to the high-frequency resonator switch 22 to the tip thereof can be ignored, and the impedance at the point of connection to the high-frequency resonator switch 22 at the resonance frequency is determined by the resistance thereof. Thus, the resistance of the switch has a direct effect on the insertion loss.

On the other hand, in the variable resonator according to the present invention, when the terminal switch 7 is turned on, the first resonator and the second resonator are connected in parallel with each other, and thus, the effect of the resistance of the switch is reduced as in the parallel connection of resistors. Thus, the loss is reduced. As described above, the present invention provides a variable resonator that has a wide range of variation of frequency and a low loss.

Next, specific examples of the variable resonator according to the present invention will be described. FIGS. 3A and 3B show an example in which the first resonator 4 and the second resonator 6 have a line length equal to a quarter of a wavelength $\lambda_{5G}$ for a frequency of 5 GHz, which is equivalent to a phase of 90 degrees. FIGS. 3A and 3B show the resonance frequencies in the state the terminal switch 7 is turned off and in the state the terminal switch 7 is turned on, respectively. The ordinate axis indicates the S parameter $S_{11}$ (dB), which indicates the ratio of the signals input to and reflected from the input/output line 3. The abscissa axis indicates the frequency, which ranges from 0 to 15 GHz in this example.

A frequency at which the parameter $S_{11}$ shows a steep drop represents a resonance frequency. When the terminal switch 7 is turned off, as shown in FIG. 3A, within the range up to 15 GHz, resonance occurs at frequencies of 2.5 GHz, 7.5 GHz and 12.5 GHz. When the terminal switch 7 is turned on, as shown in FIG. 3B, within the range up to 15 GHz, resonance occurs at frequencies of 5.0 GHz and 10.0 GHz. The reason why resonance occurs at these frequencies is because, when the terminal switch 7 is turned off, resonance occurs at frequencies at which the combined admittance of the first resonator 4 and the second resonator 6 expressed by the equation (6) described above is 0, and when the terminal switch 7 is turned on, resonance occurs at frequencies at which the combined admittance expressed by the equation (2) is 0.

FIG. 3C shows a table that summarizes these relationships. In this example, the first resonator 4 and the second resonator 6 are designed in such a manner that the physical line lengths La and Lb thereof are both equal to $\lambda_{5G}/4$(La=$\lambda_{5G}/4$, and Lb=$\lambda_{5G}/4$). Therefore, the electrical length βL at the frequency of 2.5 GHz is equivalent to a phase of 45 degrees. In this way, the electrical length and thus the admittance change depending on the frequency.

A case where the terminal switch 7 is turned off will be described first. Since La=Lb in this example, resonance occurs at frequencies at which the admittances of the first resonator 4 and the second resonator 6 are equal to each other at the phase angle, and the combined admittance is 0. In this example, the combined admittance is 0 at three frequencies of 2.5 GHz, 7.5 GHz and 12.5 GHz. In this way, the combined admittance is 0 at frequencies that are odd multiples of 2.5 GHz.

Then, when the terminal switch 7 is turned on, the combined admittance is expressed by the equation (2) described above, and resonance occurs at frequencies at which the admittances of the first resonator 4 and the second resonator 6 are 0. Specifically, resonance occurs at frequencies of 5.0 GHz and 15.0 GHz, at which the value of cot βL is 0. In this case, as in the case where the terminal switch 7 is turned off, the value of cot βL is 0 at frequencies that are odd multiples of 5.0 GHz.

In this way, in the example shown in FIGS. 3A and 3B, within the frequency range up to 15 GHz, the variable resonator resonates at three frequencies of 2.5 GHz, 7.5 GHz and 12.5 GHz when the terminal switch 7 is turned off and two frequencies of 5.0 GHz and 15.0 GHz when the terminal switch 7 is turned on.

FIGS. 4A, 4B and 4C show resonance frequencies in the case where the variable resonator is designed in such a manner that La=$5\lambda_{5G}/18$, and Lb=$2\lambda_{5G}/9$. The relationship between the abscissa axis and the ordinate axis in FIGS. 4A and 4B is exactly the same as that in FIGS. 3A and 3B. In this example, since the first resonator 4 and the second resonator 6 have different line lengths La and Lb of 5λ5G/18 and $2\lambda_{5G}/9$, respectively, harmonics (spurious frequencies) appear in a different way, compared to the case where the first and second resonators have the same length, when the terminal switch 7 is turned on.

When the terminal switch 7 is turned on, the admittances of the first resonator 4 having a line length of La and the second resonator 6 having a line length of Lb are determined by the value of $Y_0 \cdot \cot \beta L$ as can be seen from the equation (1). Thus, the combined admittance of the first resonator 4 and the second resonator 6 is 0, and thus resonance occurs at frequencies of 5.0 GHz, 10.0 GHz and 15.0 GHz at which the admittances determined by the values of Cot βLa and cot βLb are opposite in polarity and equal in absolute value.

When the terminal switch 7 is turned off, the admittance of the second resonator 6 is determined by the value of $Y_0 \cdot \tan\beta Lb$, and thus, resonance occurs at frequencies at which the values of tan βLb and cot βLa equal to each other. In this example, as in the case shown in FIG. 3A, resonance occurs at three frequencies of 2.5 GHz, 7.5 GHz and 12.5 GHz.

FIGS. 5A and 5B show another example. FIG. 5A shows resonance frequencies when the terminal switch 7 is turned off in the case where La=$\lambda_{5G}/3$, and Lb=$\lambda_{5G}/6$. The relationship between the abscissa axis and the ordinate axis in FIGS. 5A and 5B is the same as those in FIGS. 3A and 3B and FIGS. 4A and 4B. In addition, FIG. 5C shows a table that summarizes the relationships similar to those shown in FIG. 4C.

In this example, the resonance frequencies at the time when the terminal switch 7 is turned off shown in FIG. 5A differ from those shown in FIGS. 3A and 4A. The line length La, which equals to $\lambda_{5G}/3$ at the frequency of 5 GHz, equals to $\lambda_{2.5G}/6$ at the frequency of 2.5 GHz, which is equivalent to a phase angle of 60 degrees. The line length La, which equals to $\lambda_{5G}/6$ at the frequency of 5 GHz, equals to $\lambda_{2.5G}/12$, which is equivalent to a phase angle of 30 degrees. Since the terminal switch 7 is turned off, the admittance of the second resonator 6 having a line length of Lb is determined by the value of tan βLb, which is 0.57. The admittance of the first resonator 4 having a line length of La is determined by the value of cot βLa, which is 0.57 for a phase angle of 60 degrees. Thus, at the frequency of 2.5 GHz, the admittances of the first and second resonators having line lengths of La and Lb, respectively, equal to each other, the combined admittance (expressed by the equation (6)) is 0, and thus, resonance occurs. Thus, the fundamental frequency is 2.5 GHz, which equals to that in the examples described above.

As for the frequency of 7.5 GHz at which resonance occurs in the examples shown in FIGS. 3A and 4A, the line length La, which equals to $\lambda_{5G}/3$ at the frequency of 5 GHz, equals to $\lambda_{7.5G}/2$ at the frequency of 7.5 GHz, which is equivalent to a phase angle of 180 degrees. Line length La, which equals to $\lambda_{5G}/6$ at the frequency of 5 GHz, equals to $\lambda_{7.5G}/4$ at the frequency of 7.5 GHz, which is equivalent to a phase angle of 90 degrees. The admittance of the first resonator 4 having a line length of La is determined by the value of cot βLa, which equals to negative infinity for a phase angle of 180 degrees. The admittance of the second resonator 6 having a line length of Lb is determined by the value of tan βLb, which equals to negative infinity for a phase angle of 90 degrees. As a result, the combined admittance is indeterminate, and thus, resonance does not occur at the frequency of 7.5 GHz.

In this way, appropriate selection of the line lengths La and Lb allows control of the fundamental frequency and the spurious frequency. The resonance frequency at the time when the terminal switch 7 is turned on shown in FIG. 5B is the same as the frequency shown in FIG. 4B. Because the resonance conditions are not changed, descriptions of FIGS. 5A to 5C will be omitted. See FIG. 5C.

As described above, in the case where the variable resonator according to the present invention is used in a radio device, for example, a resonance frequency not necessary for the radio system can be removed by appropriately designing the line length La of the first resonator and the line length Lb of the second resonator.

Another method of increasing the combinations of resonance frequencies, which change according to the on/off state of the terminal switch 7, will be described with reference to FIGS. 6A to 6D. By changing the characteristic impedance of a portion of the resonance line of the resonator along the length of the line, the resonance frequency can be changed.

Figure 6A:
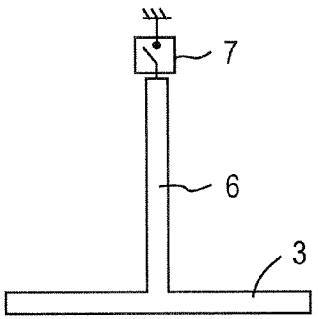
FIG. 6A shows a second resonator whose line width is uniform.
Figure 6B:
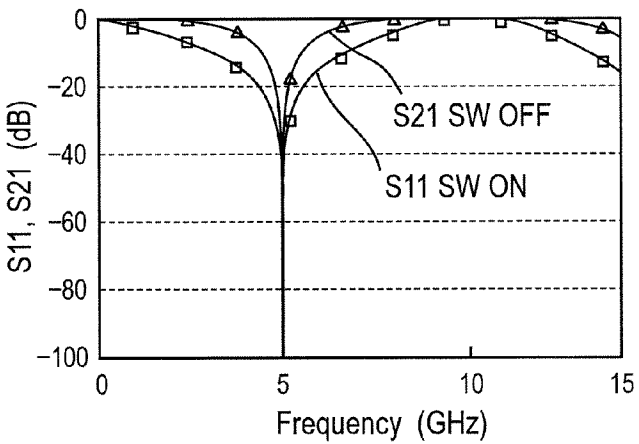
FIG. 6B is a graph showing a frequency characteristic for the configuration shown in FIG. 6A.

FIG. 6A is a diagram showing only the second resonator 6 whose one end is grounded or opened by the terminal switch 7. FIG. 6B shows an S parameter $S_{11}$ that indicates the ratio of the reflected signal to the input signal in the case where the terminal switch 7 is turned on and an S parameter $S_{21}$ that indicates the ratio of the transmitted signal to the input signal in the case where the terminal switch 7 is turned off, with the line length of the first resonator 6 being designed to be a quarter of the wavelength at a frequency of 5 GHz.

In FIG. 6B, the abscissa axis indicates the frequency, and the ordinate axis indicates the S parameters $S_{11}$ and $S_{21}$ in dB. In the state where the switch 7 is turned on, the parameter $S_{11}$ drops, and resonance occurs at 5 GHz. In the state where the switch 7 is turned off, the parameter $S_{21}$ drops, and no signal is transmitted to the output at 5 GHz. A so-called series resonance occurs.

Thus, in terms of signal input/output, the variable resonator functions as a band pass filter that transmits signals well when the terminal switch 7 is turned on and functions as a band rejection filter that transmits no input signal to the output when the terminal switch 7 is turned off. Although the variable resonator functions in opposite ways depending on the on/off state of the terminal switch 7, the resonance frequency of 5 GHz is not changed. In this way, in the case where the line width of the second resonator 6 is constant as shown in FIG. 6A, the resonance frequency does not change depending on the on/off state of the terminal switch 7.

Figure 6C:
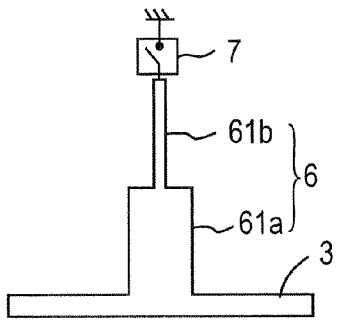
FIG. 6C shows a second resonator having a step impedance resonator structure to increase the combinations of resonance frequencies, which change according to the on/off state of the terminal switch 7.
Figure 6D:
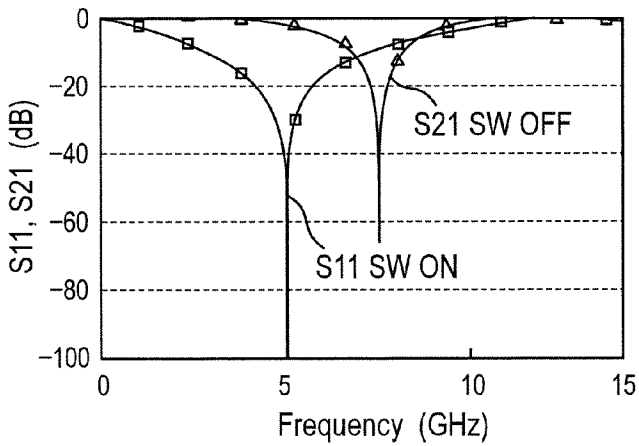
FIG. 6D is a graph showing a frequency characteristic for the configuration shown in FIG. 6C.

FIG. 6C shows an example in which the characteristic impedance of the line 6 is changed at a point therein. For example, it is assumed that a line 61*a* connected to the input/output line 3 has a characteristic impedance of 45Ω, and a line 61*b* extending from the line 61*a* and connected to the terminal switch 7 has a characteristic impedance of 90Ω. Such a line 6 is referred to as step impedance resonator, because the characteristic impedance changes stepwise. FIG. 6D shows the S parameter $S_{11}$ at the time when the terminal switch 7 is turned on and the S parameter $S_{21}$ at the time when the terminal switch 7 is turned off in the case where the total length of the line 61*a* and 61*b* is designed to be a certain length. The reason why the line length is described as "a certain length" is because FIG. 6C is a diagram merely for illustrating the effect of the terminal switch 7 in the case where the line has the step impedance resonator structure. In the description of FIG. 6C, the total line length of the line 61*a* and 61*b* has no significance.

First, when the terminal switch 7 is turned off, the series resonance frequency at which the S parameter $S_{21}$ steeply drops is 7.5 GHz. When the terminal switch 7 is turned on, the resonance frequency changes to 5 GHz, unlike the case shown in FIG. 6B. In this way, the resonance frequency at the time when the terminal switch 7 is turned on and the series resonance frequency at the time when the terminal switch 7 is turned off differ from each other. This is because the line has the step impedance resonator structure.

When the terminal switch 7 is turned off, the impedance at the tip of the line 61*b* is open. The closer to the input/output line 3, the lower the impedance becomes, and the impedance of the line 61*b* viewed from the intersection of the line 61*a* and the input/output line 3 is 0 at the series resonance frequency.

The energy of the electrical field is concentrated at the region of high impedance, and the energy of the magnetic field is concentrated at the region of low impedance. Thus, the region of high impedance is highly capacitive, and the region of low impedance is highly inductive. The resonance frequency F, which is specific for each line, can be approximated to the following well-known equation (8) using a capacitive component C and an inductive component L, which are reactance components of the line.

$$F=1/(2\pi\sqrt{LC}) \tag{8}$$

Thus, in the case where the terminal switch 7 is turned off, regions close to the intersection of the line 61*a* and the input/output line 3 are highly inductive, and regions close to the tip of the line 61*b* close to the terminal switch 7 are highly capacitive. In the case shown in FIG. 6C, the line 61*a* close to the input/output line 3 that is highly inductive has a wider line width, so that the inductive reactance is reduced. In addition, the line 61*b* close to the terminal switch 7 that is highly capacitive has a narrower line width, so that the capacitive reactance is also reduced. As a result, compared with the resonator that has a uniform line width as shown in FIG. 6A, the resonance frequency at the time when the terminal switch 7 is turned off can be increased.

On the other hand, when the terminal switch 7 is turned on, as in the case shown in FIG. 6A, regions close to the intersection of the line 61*a* and the input/output line 3 is highly capacitive, and regions close to the tip of the line 61*b* close to the terminal switch 7 is highly inductive. However, since the line that is highly capacitive has a wider line width, the capacitive reactance can be increased. In addition, since the line 61*b* that is highly inductive has a narrower line width, the inductive reactance can be increased. Thus, in the case of the line configuration shown in FIG. 6C, the resonance frequency at the time when the terminal switch 7 is turned on can be reduced, compared with the resonator that has a uniform line width. In this way, the resonance frequency can be controlled by configuring the line of the resonator as the step impedance resonator structure.

In the case where such a variable resonator is used in a radio system, the harmonic immediately next to the fundamental frequency may be a problem. The next harmonic is the third harmonic having a frequency of 7.5 GHz in the case of the fundamental frequency of 2.5 GHz shown in FIG. 3A or the harmonic having a frequency of 10.0 GHz in the case of the fundamental frequency of 5.0 GHz shown in FIG. 5B, for example, and it may be preferred that the next harmonic does not exist depending on the radio system using the variable resonator. In order to eliminate the harmonic immediately next to the fundamental frequency, the step impedance resonator structure can be used, for example.

For example, for the combination of the electrical length of 120 degrees of the first resonator 4 (at 5 GHz) and the electrical length of 60 degrees of the second resonator 6 (at 5 GHz) shown in FIG. 5A, the fundamental frequency is 2.5 GHz, and the next harmonic has a frequency of 12.5 GHz, rather than the frequency of 7.5 GHz of the third harmonic. On the other hand, when the switch 7 is turned on, as shown in FIG. 5B, there exists a harmonic having a frequency of 10 GHz, which is twice as high as the resonance frequency of 5 GHz. In addition, a case where the second harmonic does not exist when the terminal switch 7 is turned on is shown in FIG. 3B. In this case, the second resonator 6 has to have an electrical length of 90 degrees (at 5 GHz). Compared with the case where the terminal switch 7 is turned on at the same frequency of 5 GHz shown in FIG. 5B, the electrical length of the second resonator 6 is increased by 30 degrees.

Thus, configuring the second resonator 6 shown in FIG. 5B as the step impedance resonator structure can make one line function as two lines. According to the principle described above, by using the step impedance resonator structure, the electrical length of 60 degrees can be achieved when the terminal switch 7 is turned off, and the apparent electrical length of 90 degrees can be achieved when the terminal switch 7 is turned on. Of course, in this case, the line length of the first resonator 4 has to be changed from 120 degrees to 90 degrees (at 5 GHz) when the terminal switch 7 is turned on. Although such a change in electrical length is required, if the line having the step impedance resonator structure is used, the apparent electrical length of the one line can be changed with the frequency, and a plurality of resonance frequencies can be obtained with a reduced number of switching parts. Here, in the example shown in FIG. 6C, the line 61*a* connected to the input/output line 3 is wider. However, the line 61*b* may be wider. In that case, the resonance frequency can be changed in the direction opposite to the case shown in FIG. 6D. That is, compared with a resonator having a uniform line width, the resonance frequency at the time when the terminal switch 7 is turned off can be reduced, and the resonance frequency at the time when the terminal switch 7 is turned on can be increased.

As described above, according to the present invention, there is provided a variable resonator that has a wide range of variation of frequency and a low loss and whose resonance frequency can be arbitrarily set.

Figure 7B:
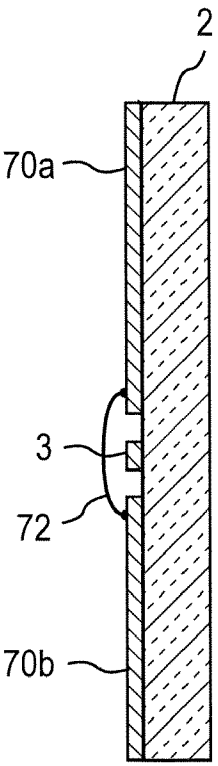
FIG. 7B is a cross-sectional view taken along the line 7B-7B in FIG. 7A.
Figure 7A:
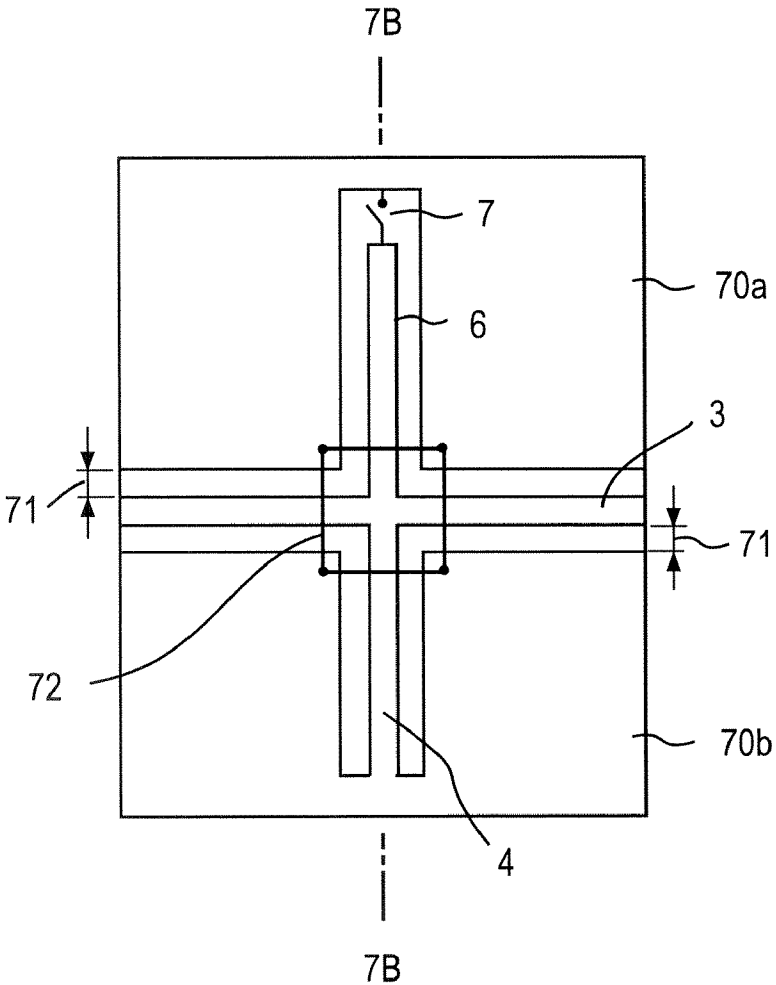
FIG. 7A is a plan view of a variable resonator according to the present invention having a coplanar line structure.

Although the variable resonator according to the present invention shown in FIG. 1A has a microstrip line structure, the present invention is not limited to the variable resonators having the microstrip line structure. A coplanar line structure or a coaxial line structure may be used. FIGS. 7A and 7B show an example in which the variable resonator according to the present invention shown in FIGS. 1A and 1B is configured as a coplanar line structure. The ground conductor 1 that is formed over one surface of the dielectric substrate 2 in FIGS. 1A and 1B is omitted, and ground conductors 70*a* and 70*b* are formed on the same surface of the dielectric substrate 2 as the first resonator 4 and the second resonator 6.

The ground conductors 70*a* and 70*b* are disposed close to the input/output line 3 and the resonance lines of the first resonator 4 and the second resonator 6 with a gap 71 therefrom. The corners of the ground conductors 70*a* and 70*b* adjacent to the connections of the resonators to the input/output line 3 are electrically connected to each other via a bonding wire 72 in order to keep the potentials of the ground conductors 70*a* and 70*b* equal.

In this way, the variable resonator according to the present invention that has a coplanar line structure can also be provided.

SECOND EMBODIMENT

According to the first embodiment described above, a variable resonator having a wide range of variation of frequency can be provided. However, the interval between the resonance frequencies is relatively wide, such as integral multiples of the fundamental frequency. As a second embodiment, there will be described examples of a variable resonator that has a resonance frequency capable of being more finely resolved (that is, changed in smaller steps) and has a wider range of variation of frequency.

Figure 22:
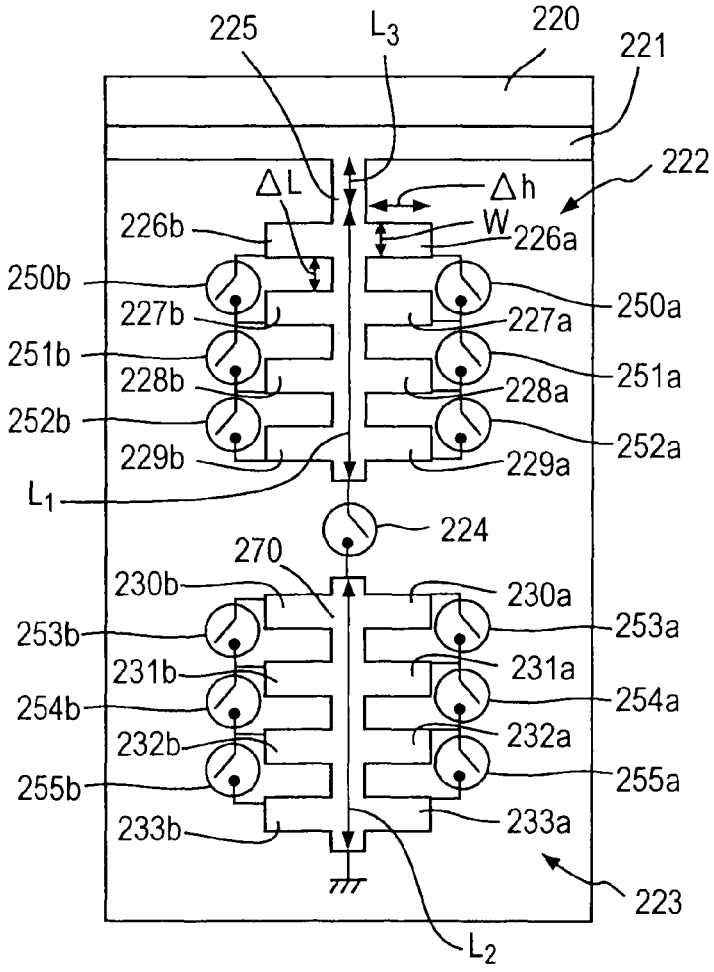
FIG. 22 PRIOR ART
FIG. 22 is a diagram showing an exemplary prior-art variable resonator.

In advance of the description of the second embodiment, the skin effect, which is utilized also in the prior art shown in FIG. 22, will be described.

Electric signals transmitted through a resonance line are more likely to be concentrated at the outer periphery of the resonance line as the frequency increases. This is due to the skin effect of high-frequency signals. In the case where an electric signal is transmitted through a conductor, the penetration depth of the signal in the width direction is referred to as skin depth and expressed by the following equation (9).

$$\text{Skin Depth}=1/\sqrt{\pi f\sigma\mu} \tag{9}$$

In this equation, f denotes the frequency, $\sigma$ denotes the conductivity of the conductor, and $\mu$ denotes the permeability of the conductor.

Figure 8A:
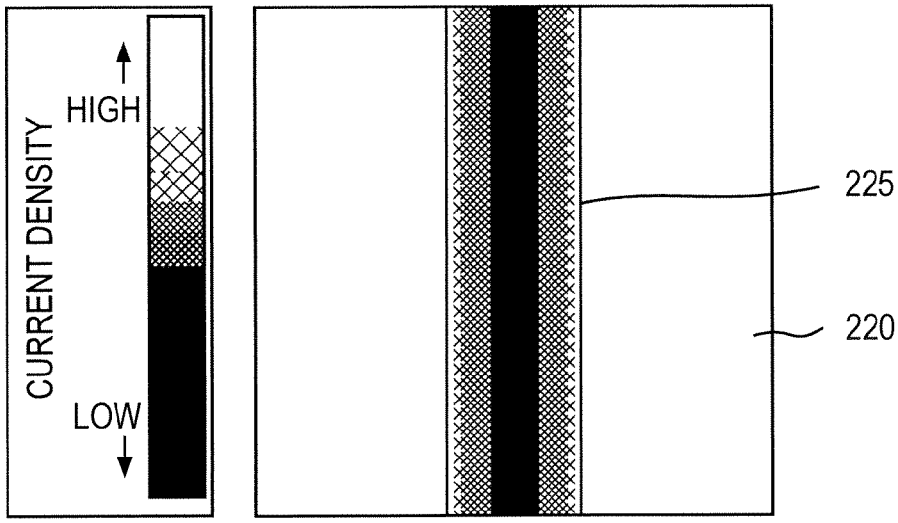
FIG. 8A is a diagram showing a current density distribution of a part having a uniform line width, which is intended to explain the skin effect.
Figure 8B:
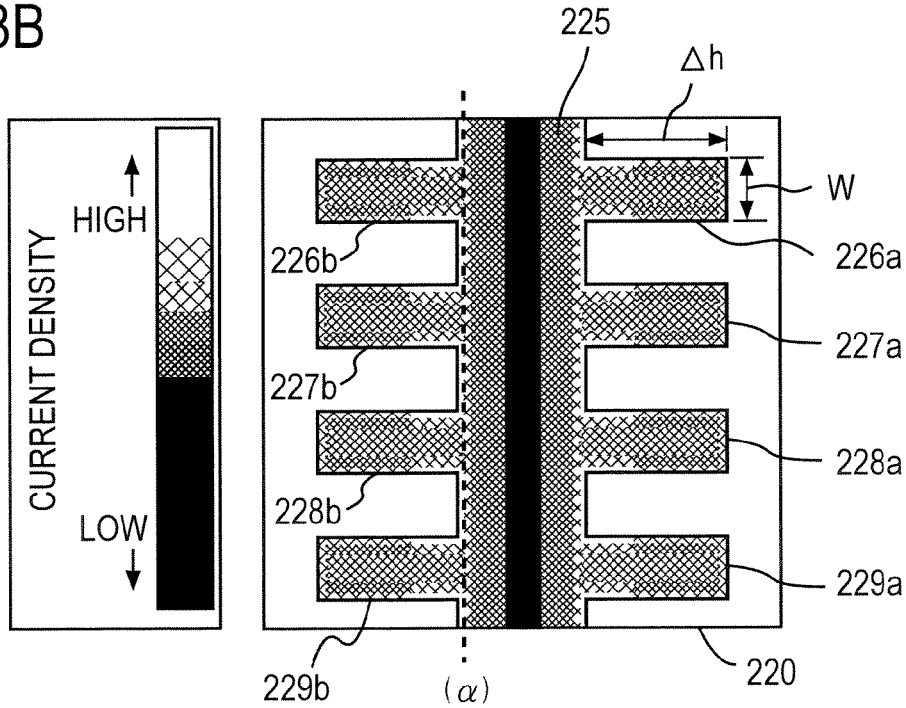
FIG. 8B is a diagram showing a current density distribution of a part having varying widths.

FIGS. 8A and 8B show current density distributions of a microstrip line structure that has lines made of silver, for example. FIG. 8A shows only a part of the first line 225 of the prior-art variable resonator described above with reference to FIG. 22 in an enlarged manner. As can be seen from this drawing, the current is most concentrated at the edge of the line. FIG. 8B shows a part of the first line 225 and the second lines 226*a* to 229*b*. As can be seen from this drawing, if the second lines 226*a* to 229*b* are added to the first line 225, and the resonance line has various widths, the current flows along the outer periphery of the line rather than along the shortest path (line $\alpha$), so that the path of the current flow is longer than the shortest path. This is because the electric signals tend to flow without penetrating into the line beyond the skin depth. By using this effect, the resonator can be downsized. In addition, the resonance frequency of the variable resonator can be changed in small steps.

EXAMPLE 1

Figure 9A:
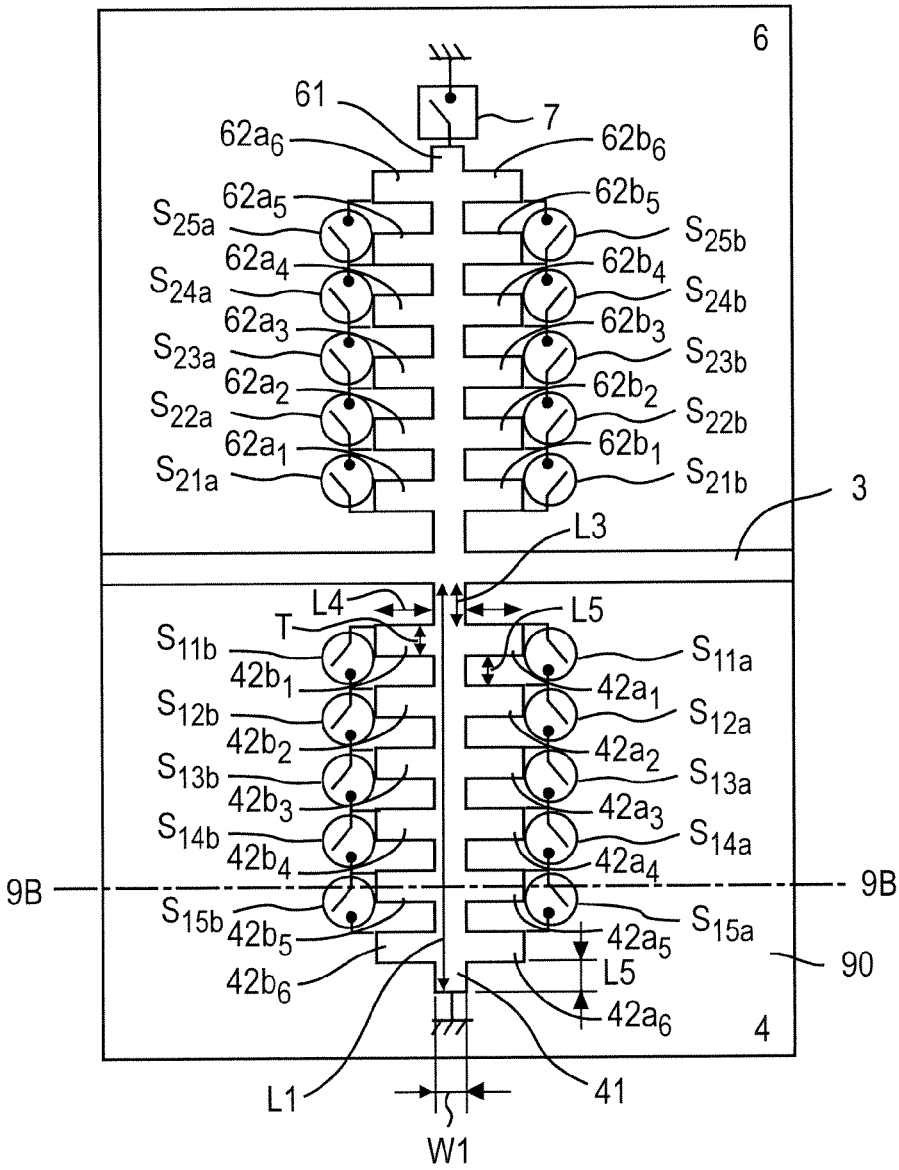
FIG. 9A shows an exemplary variable resonator according to the present invention whose frequency resolution is improved by using the skin effect.
Figure 9B:
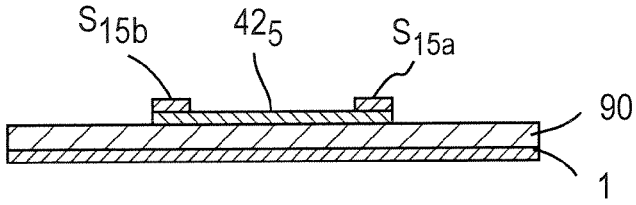
FIG. 9B is a cross-sectional view taken along the line 9B-9B in FIG. 9A.

FIGS. 9A and 9B show an example in which the skin effect is applied to the variable resonator according to the present invention, thereby increasing the resolution of the variable resonance frequency.

A dielectric substrate 90 has a rectangular strip shape in a plan view, and an input/output line 3 formed on the dielectric substrate 90 and extends in parallel with the shorter sides thereof at about the middle of the longer sides thereof. On one side of the input/output line 3, a first resonator 4 is connected perpendicularly to the input/output line 3 at about the middle of the input/output line 3. A second resonator 6 is similarly connected on the other side of the input/output line 3.

In this example 1, the first resonator 4 and the second resonator 6 have shapes that exhibit the skin effect and have an increased resolution of the resonance frequency. The resonance line of the first resonator 4 comprises a combination of two kinds of lines including a first line 41 having a length of L1 and a width of W1 approximately equal to the width of the input/output line 3 and second lines $\mathbf{42}_{a1}$ to $\mathbf{42}_{a6}$ and $\mathbf{42}_{b1}$ to $\mathbf{42}_{b6}$ having a length of L4 and a width of T and connected on the opposite sides of the first line 41 perpendicularly thereto.

The paired second lines $\mathbf{42}_{a1}$ and $\mathbf{42}_{b1}$ are disposed at a distance of L3 from the point of connection of one end of the first line 41 to the input/output line 3 and extend for a length of L4 from the first line 41 in opposite directions perpendicular to the first line 41.

On the side of the second lines $\mathbf{42}_{a1}$ and $\mathbf{42}_{b1}$ opposite from the input/output line 3, the second lines $\mathbf{42}_{a2}$ and $\mathbf{42}_{b2}$ having the same shape as the second lines $\mathbf{42}_{a1}$ and $\mathbf{42}_{b1}$ are disposed at a distance of L5 from the second lines $\mathbf{42}_{a1}$ and $\mathbf{42}_{b1}$ along the first line 41. Following the second lines $\mathbf{42}_{a2}$ and $\mathbf{42}_{b2}$, the remaining four pairs of second lines $\mathbf{42}_{a3}$, $\mathbf{42}_{b3}$, $\mathbf{42}_{a4}$, $\mathbf{42}_{b4}$, $\mathbf{42}_{a5}$, $\mathbf{42}_{b5}$, $\mathbf{42}_{a6}$ and $\mathbf{42}_{b6}$ are disposed at the same intervals of L5, and the other end of the first line 41 protrudes by a length of L5 on the side of the second lines $\mathbf{42}_{a6}$ and $\mathbf{42}_{b6}$ opposite to the input/output line 3. The other end of the first line 41 is grounded to a ground conductor 1 through a via hole 5.

The resonance line is configured as described above. For the convenience of explanation, the resonance line has been described as being composed of a combination of two kinds of lines including the first line 41 and the second lines $\mathbf{42}_{a1}$ to $\mathbf{42}_{b6}$. In actual, however, the resonance line is formed in a single piece. It can be considered that the single-piece resonance line comprises parts having a width W1, which equals to the width of the first line 41, and parts having a width (2L4+W1) along the paired second lines $\mathbf{42}_{a1}$ to $\mathbf{42}_{b6}$, which are alternately arranged.

The line length of the single-piece resonance line is approximately equal to the length of the outer periphery of the resonance line composed of the first line 41 and the second lines $\mathbf{42}_{a1}$ to $\mathbf{42}_{b6}$. This is because, in the case where the width of the resonance line varies as described above, the current flowing through the line tends to mainly flow along the outer periphery of the line rather than along the shortest path because of the skin effect, so that the current flows along a path longer than the shorter path. The path length in this example is longer than L1 and shorter than L3+n(2L4+T)+nL=2L4*n*+L1. If the values of L5 and T are set equal to or greater than the skin depth, the path length can be approximated to the length L3+n(2L4+T)+nL5. In this example, n is equal to 6. The term 2nL4 means the expansion of the line by the plurality of second lines $\mathbf{42}_{a1}$ to $\mathbf{42}_{b6}$ arranged along the first line 41.

In this example, in order to increase the resolution of the resonance frequency of the variable resonator, a plurality of short-circuiting switches are provided that interconnect the free ends of every adjacent two of the second lines $\mathbf{42}_{a1}$ to $\mathbf{42}_{b6}$. Short-circuiting switches $S_{11a}$ and $S_{11b}$ are connected between the corners of the free ends of the second lines $\mathbf{42}_{a1}$ and $\mathbf{42}_{b1}$ closer to the input/output line 3 and the corners of the free ends of the second lines $\mathbf{42}_{a2}$ and $\mathbf{42}_{b2}$ closer to the input/output line 3, respectively. Similarly, following the short-circuiting switches $S_{11a}$ and $S_{11b}$, short-circuiting switches $S_{12a}$ and $S_{12b}$ are connected between the second lines $\mathbf{42}_{a2}$ and $\mathbf{42}_{a3}$ and between the second lines $\mathbf{42}_{b2}$ and $\mathbf{42}_{b3}$, respectively, short-circuiting switches $S_{13a}$ and $S_{13b}$ are connected between the second lines $\mathbf{42}_{a3}$ and $\mathbf{42}_{a4}$ and between the second lines $\mathbf{42}_{b3}$ and $\mathbf{42}_{b4}$, respectively, short-circuiting switches $S_{14a}$ and $S_{14b}$ are connected between the second lines $\mathbf{42}_{a4}$ and $\mathbf{42}_{a5}$ and between the second lines $\mathbf{42}_{b4}$ and $\mathbf{42}_{b5}$, respectively, and short-circuiting switches $S_{15a}$ and $S_{15b}$ are connected between the second lines $\mathbf{42}_{a5}$ and $\mathbf{42}_{a6}$ and between the second lines $\mathbf{42}_{b5}$ and $\mathbf{42}_{b6}$, respectively.

The pairs of short-circuiting switches $S_{11a}$ and $S_{11b}$ to $S_{15a}$ and $S_{15b}$ connected to the free ends of the second lines $\mathbf{42}_{a1}$ to $\mathbf{42}_{b6}$ are controlled so that any number of pairs are selectively turned on or off at the same time (in the following, a reference symbol $S_{*}$ denotes any one or more short-circuiting switches). For example, if the paired short-circuiting switches $S_{11a}$ and $S_{11b}$ are turned on, the path length of the resonator line can be shorted by 2L4. That is, when all the short-circuiting switches $S_{*}$ are turned off, the resonance path length is maximized and equals to L3+n(2L4 +T)+nL5, and when all the short-circuiting switches $S_{*}$ are turned on, the resonance path length is minimized and equals to L3+T+2L4+L5. The path length can be changed between the maximum value and the minimum value in steps of 2L4 depending on the number of pairs of short-circuiting switches $S_{*}$.

As described above, the first resonator 4 is composed of the first line 41, the second lines $\mathbf{42}_{a1}$ to $\mathbf{42}_{b6}$ and the short-circuiting switches $S_{*}$. On the side of the input/output line 3 opposite to the first resonator 4, a first line 61 of the second resonator 6 and second lines $\mathbf{62}_{a1}$ to $\mathbf{62}_{a6}$ and $\mathbf{62}_{b1}$ to $\mathbf{62}_{b6}$ are provided and short-circuiting switches $S_{21a}$, $S_{21b}$ to $S_{25a}$, $S_{25b}$ are arranged on the opposite sides of the first line 61**.

The second resonator 6 has exactly the same configuration as the first resonator 4 and is disposed at a position 180-degrees rotationally symmetric to the first resonator 4 described above with respect to the input/output line 3. The detailed configuration of the second resonator 6 is the same as that of the first resonator 4 and will not be further described. See FIG. 9A. The only difference of the second resonator 6 from the first resonator 4 is that the other end of the first line 61 is grounded to a ground conductor 1 via a terminal switch 7.

As described above, the path lengths of the first resonator 4 and the second resonator 6 of the variable resonator according to the example 1 can be changed by the short-circuiting switches $S_{***}$ in small steps.

The terminal switch 7 and the short-circuiting switches $S_{*}$ can be implemented as a mechanical switch using the micro electromechanical systems (MEMS) technology, for example. Of course, each of those switches may be implemented as a semiconductor switching element, such as a field effect transistor (FET) and a PIN diode. FIG. 9B is a cross-sectional view taken along the line 9B-9B in FIG. 9**A. From this drawing, it can be seen that the short-circuiting switches $S_{15a}$ and $S_{15b}$ are disposed on the surface of the second lines $\mathbf{42}_{a5}$ and $\mathbf{42}_{b5}$ at the respective free ends.

Figure 10:
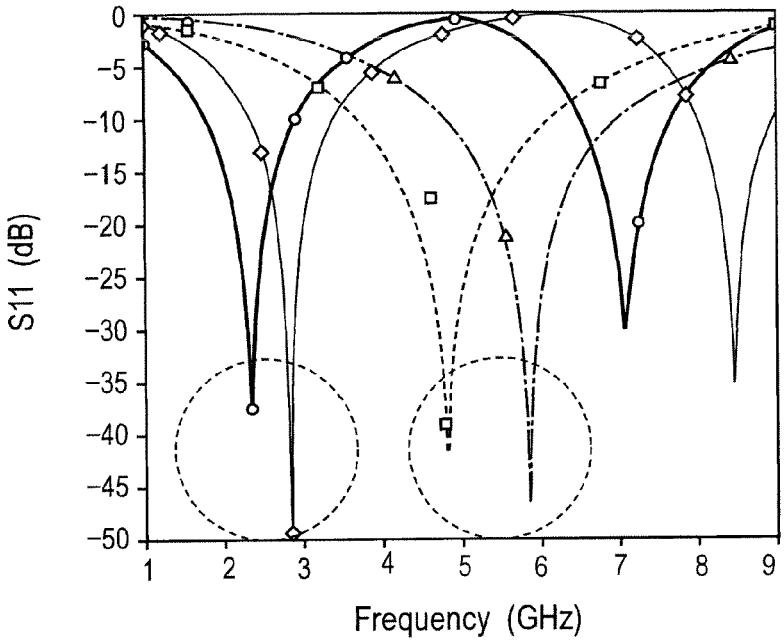
FIG. 10 is a graph showing a frequency characteristic of the variable resonator shown in FIG. 9A.

FIG. 10 shows an exemplary variation of the resonance frequency of the variable resonator configured as shown in FIGS. 9A and 9B according to the present invention in the cases where the terminal switch 7 and the short-circuiting switches $S_{*}$ are turned on and off. In FIG. 10**, the abscissa axis indicates the frequency (GHz), and the ordinate axis indicates the S parameter $S_{11}$ (dB).

The thick line in FIG. 10 indicates the characteristic in the case where the terminal switch 7 is turned off, and all the short-circuiting switches $S_{*}$ are turned off. Resonance occurs at about 2.3 GHz and 7.0 GHz. The thin line indicates the characteristic in the case where the terminal switch 7 is turned off, and all the short-circuiting switches $S_{*}$ are turned on. The resonance frequency changes from about 2.3 GHz to 2.8 GHz (and from 7.0 GHz to 8.5 GHz). This means that turning all the short-circuiting switches $S_{*}$ on minimizes the path length, thereby raising the resonance frequencies. Although not shown, if 5 pairs of short-circuiting switches $S_1$ and $S_2$ are provided as shown in FIGS. 9A and 9**B, five or more resonance frequencies exist between 2.3 GHz and 2.8 GHz.

The dashed line indicates the characteristic in the case where the terminal switch 7 is turned on, and all the short-circuiting switches $S_{*}$ are turned off. Resonance occurs at about 4.8 GHz. The alternate long and short dash line indicates the characteristic in the case where the terminal switch 7 is turned on, and all the short-circuiting switches $S_{*}$ are turned on. Compared with the case indicated by the dashed line, the resonance frequency changes from about 4.8 GHz to 5.9 GHz. This change also occurs because turning all the short-circuiting switches $S_{***}$ on minimizes the path length. Thus, again, five or more resonance frequencies exist between 4.8 GHz and 5.9 GHz.

As described above, the variable resonator configured as shown in FIGS. 9A and 9B can broadly change the resonance frequency by turning on and off the terminal switch 7 and finely change the resonance frequency in the vicinity of the broadly changed resonance frequency by turning on and off the short-circuiting switches $S_{*}$. Although fine changes in resonance frequency by turning on and off the short-circuiting switches $S_{*}$ is not specifically described, the number of resonance frequencies and the interval between the resonance frequencies can be appropriately designed according to required specifications, as can be apparently seen from the description of FIGS. 9A and 9B.

While the paired short-circuiting switches $S_{11a}$ and $S_{11b}$ to $S_{15a}$ and $S_{15b}$ are turned on or off simultaneously in the above description, the paired short-circuiting switches may not always be controlled simultaneously. For example, the short-circuiting switch $S_{11a}$ or $S_{11b}$ alone can be turned on. In this case, the resonance frequency can still be changed, although the amount of change in resonance frequency is smaller compared with the case where the paired switches are simultaneously turned on. The short-circuiting switches $S_{11a}$, $S_{11b}$ to $S_{15a}$, $S_{15b}$ may not be provided, and the path length is effectively increased by providing the second lines, so that the first lines 41 and 61 can be advantageously shortened. In addition, while the second lines are disposed perpendicularly to the first line in the example shown in FIGS. 9A and 9B, it is obvious that the second lines may not be perpendicular to the first line. Furthermore, in the above description, the second lines $\mathbf{42}_{a1}$ to $\mathbf{42}_{a6}$ and $\mathbf{42}_{b1}$ to $\mathbf{42}_{b6}$ are disposed at regular intervals along the first line 41 in such a manner that the second lines of each pair are aligned with each other. However, the second lines $\mathbf{42}_{a1}$ to $\mathbf{42}_{a6}$ and $\mathbf{42}_{b1}$ to $\mathbf{42}_{b6}$ may be disposed in such a manner that the second lines of each pair are laterally displaced from each other. The same holds true with the second lines $\mathbf{62}_{a1}$ to $\mathbf{62}_{a6}$ and $\mathbf{62}_{b1}$ and $\mathbf{62}_{b6}$. These modifications can be equally applied to the following examples.

In the following, modified examples of the variable resonator shown in FIGS. 9A and 9B will be described.

EXAMPLE 2

Figure 11:
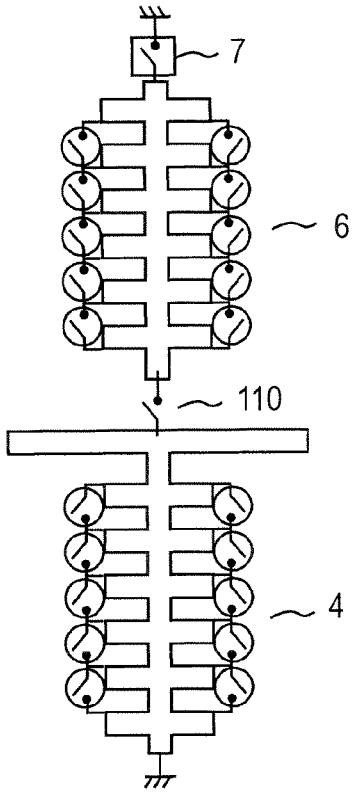
FIG. 11 shows an example 2 of the present invention.

FIG. 11 shows a variable resonator that has a variable bandwidth for the same resonance frequency. In the drawings showing the following examples, the dielectric substrate on which the variable resonator is formed is omitted. The basic configurations of the first resonator 4 and the second resonator 6 are the same as those in the example shown in FIGS. 9A and 9B. The variable resonator shown in FIG. 11 differs from the variable resonator shown in FIGS. 9A and 9B in that a shut-off switch 110 is connected between the second resonator 6 and the input/output line 3. In the case where the shut-off switch 110 is turned off, the resonance frequency is determined by the first resonator 4, of course. The resonance frequency is the same as the resonance frequency in the case where the terminal switch 7 is turned on and the shut-off switch 110 is turned on. This is because, as described above with reference to FIG. 1A, if the terminal switch 7 is turned on, the electrical length of the variable resonator becomes a half of the sum of the electrical lengths of the first resonator 4 and the second resonator 6 having the same configuration.

Thus, by turning on and off the shut-off switch 110 when the terminal switch 7 is turned on, the impedance at the frequencies other than the resonance frequency viewed from the input/output line 3 can be changed while keeping the resonance frequency constant. As a result, the variable resonator can have a variable bandwidth for the same resonance frequency.

The bandwidth is narrower when the shut-off switch 110 is turned on. The bandwidth can be changed with the impedance of the shut-off switch 110 and the characteristic impedance of the second resonator 6 according to required specifications.

EXAMPLE 3

Figure 12A:
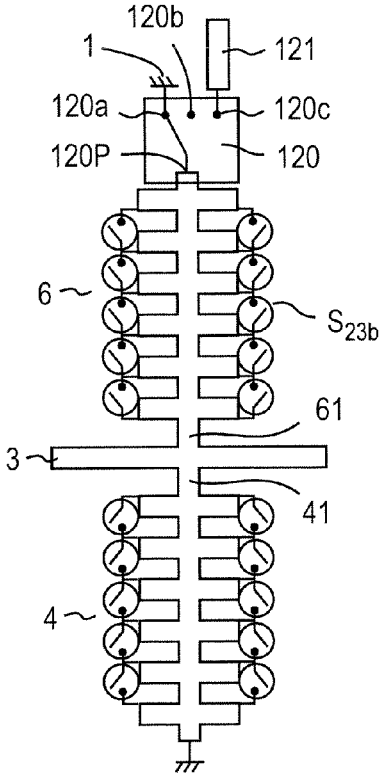
FIG. 12A shows an example 3 of the present invention.
Figure 12B:
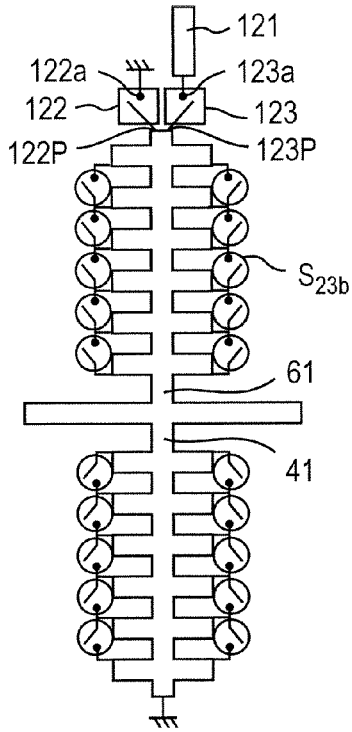
FIG. 12B shows a modified example of the example 3.

FIGS. 12A and 12B show an example in which the flexibility of the resonance frequency is increased. The basic configurations of the first resonator 4 and the second resonator 6 are the same as those in the example described above with reference to FIGS. 9A and 9B. FIG. 12A shows a variable resonator with the terminal switch 7 shown in FIG. 9A replaced with a single pole three throw switch (abbreviated as SP3T switch, hereinafter) 120. A single pole terminal 120P is connected to the tip of the first line 61, a first throw terminal 120*a* is grounded to the ground conductor 1, a second throw terminal 120*b* is opened, and a third throw terminal 120*c* is connected to one end of an additional line 121.

If the single pole terminal 120P is grounded or opened, the same operation as described above occurs. If the single pole terminal 120P is connected to the third throw terminal 120*c*, the line length of the second resonator 6 is elongated by the length of the additional line 121, so that the resonance frequency can be reduced compared with the case where the single pole terminal 120P is opened.

FIG. 12B shows a variable resonator with the SP3T switch 120 shown in FIG. 12A replaced with two single pole single throw switches (abbreviated as SPST switch, hereinafter). Single pole terminals 122P and 123P of SPST switches 122 and 123 are connected to the tip of the first line 61, a single throw terminal 122*a* of the SPST switch 122 is grounded, and a single throw terminal 123*a* of the SPST switch 123 is connected to one end of the additional line 121.

By turning the SPST switch 123 on when the SPST switch 122 is opened (turned off), the resonance frequency can be reduced compared with the case where the SPST switch 122 is turned off.

EXAMPLE 4

Figure 13:
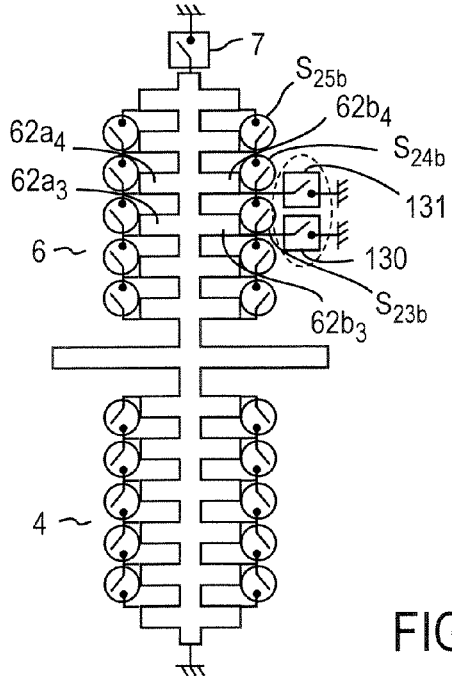
FIG. 13 shows an example 4 of the present invention.

FIG. 13 shows an example in which the number of resonance frequencies at wider intervals (discrete frequencies) is increased. The variable resonator shown in FIG. 13 differs from that shown in FIGS. 9A and 9B in that the free ends of the second lines $\mathbf{62}b_3$ and $\mathbf{62}b_4$ of the second resonator 6, to which the short-circuiting switches $S_{23b}$ and $S_{24b}$ are connected, are connected to SPST grounding switches 130 and 131 for grounding of the free ends.

The SPST grounding switches 130 and 131 serve to significantly reduce the line length of the second resonator 6. Comparing the line lengths in the cases where the terminal switch 7 and the SPST grounding switches 130 and 131 are independently turned on under the condition that all the short-circuiting switches $S_2$ on the side of the second resonator 6 are turned off, the maximum line length of L3+6(2L4+T)+6L5 described above is achieved when the terminal switch 7 is turned on. In the case where the SPST grounding switch 130 is turned on, the line length is reduced to L3+5L4+2T+2L5. In the case where the SPST grounding switch 130 is turned off, and the SPST grounding switch 131 is turned on, the line length is further reduced by 2L4+T+L5**.

In this way, the line length of the second resonator 6 can be broadly changed by turning on and off the SPST grounding switches 130 and 131. As a result, the number of resonance frequencies changing at relatively wide intervals shown in FIG. 10 can be increased by 2.

Of course, since the number of available short-circuiting switches $S_2$ decreases in the case where the SPST grounding switch 130 is turned on, in the example shown in FIG. 13**, the number of resonance frequencies finely selectable also decreases. However, an arrangement capable of finely changing the resonance frequency can be readily designed.

As described above, by providing the grounding switches, the demand for largely changing the resonance frequency at wide intervals can be satisfied.

EXAMPLE 5

Figure 14:
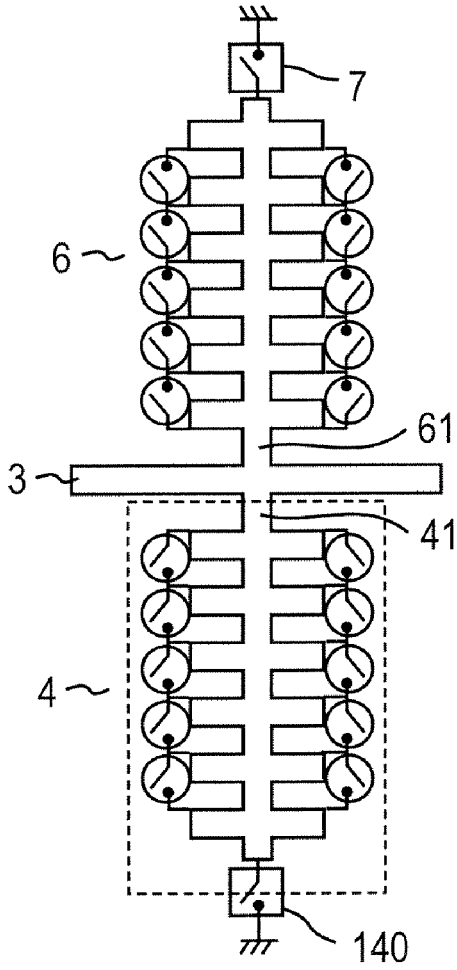
FIG. 14 shows an example 5 of the present invention.

FIG. 14 shows an example 5 in which the other end of the first line 41 of the first resonator 4 shown in FIGS. 9A and 9B is grounded via a terminal switch 140. This allows selection of the impedance of the first resonator 4 viewed from the input/output line 3 between zero and infinite.

When the terminal switches 7 and 140 are both turned on, the first lines 41 and 61 have an impedance of 0 at the tips thereof, and the impedance at the connection to the input/output line 3 at the resonance frequency is open. To the contrary, when the terminal switches 7 and 140 are both turned off, the impedance of the first lines 41 and 61 at the tips thereof is open, and the impedance at the connection to the input/output line 3 at the resonance frequency is 0.

In this case, the variable resonator functions as a band pass filter when both the switches are turned on and as a band rejection filter when both the switches are turned off, for the same frequency as shown in FIGS. 6A and 6B. In this way, by providing the terminal switch 140, the variable resonator can be made to operate in opposite ways.

EXAMPLE 6

Figure 15D:
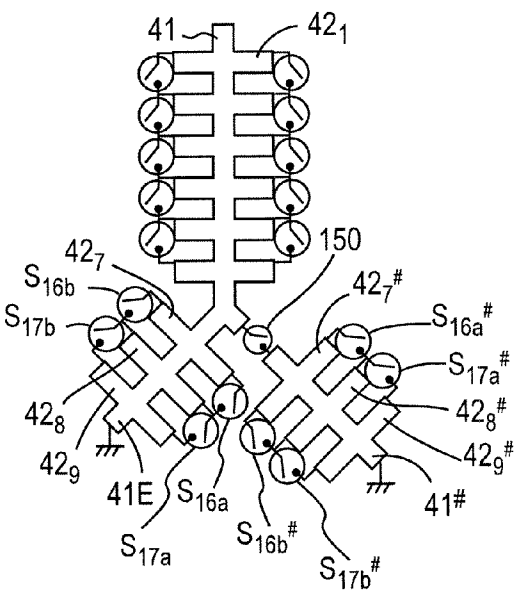
FIG. 15D shows another modified example of the first resonator shown in FIG. 15A.
Figure 15F:
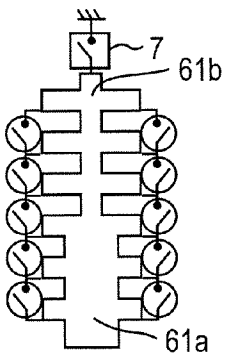
FIG. 15F shows another modified example of the second resonator shown in FIG. 15A.
Figure 15C:
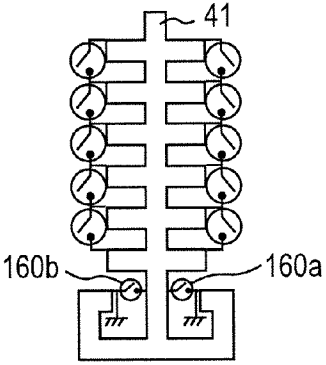
FIG. 15C shows another modified example of the first resonator shown in FIG. 15A.
Figure 15E:
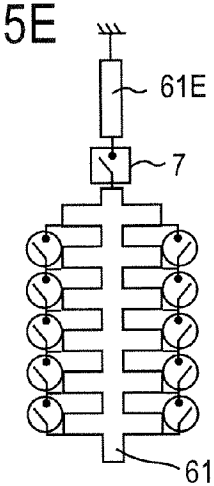
FIG. 15E shows a modified example of a second resonator shown in FIG. 15A.

In the example 5 and the preceding examples, two resonators having the same configuration are disposed on the opposite sides of the input/output line 3 to constitute the variable resonator. However, the resonators may be arranged asymmetrically with respect to the input/output line 3. Such an example is shown in FIGS. 15A to 15F. FIG. 15A shows exactly the same arrangement as described above with reference to FIG. 9A.

Figure 15B:
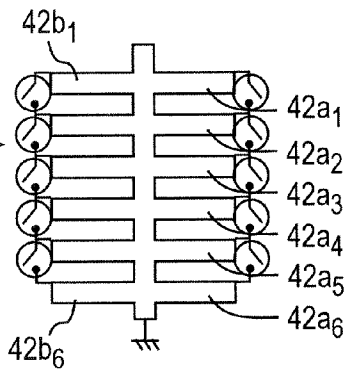
FIG. 15B shows a modified example of a first resonator shown in FIG. 15A.
Figure 15A:
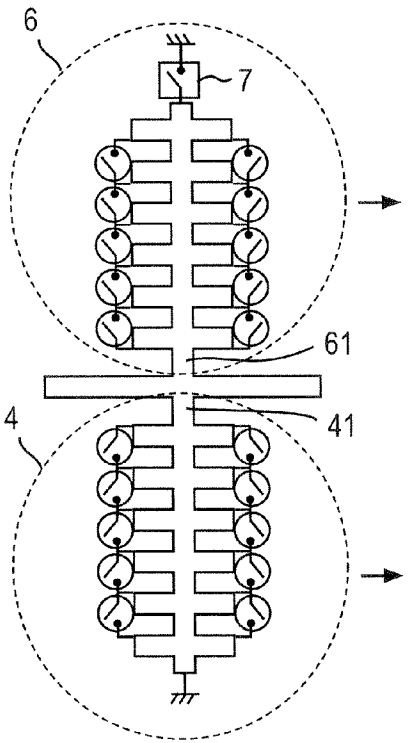
FIG. 15A shows an example 6 of the present invention.

FIG. 15B shows an example in which the second lines $\mathbf{42}_{a1}$ to $\mathbf{42}_{b6}$ of the first resonator 4 that extend perpendicularly to the first line 41 are elongated. This allows the range of variation of the resonance frequency by turn on and off of the short-circuiting switches $S_{***}$ to be widened.

FIG. 15C shows an example in which the first line 41 is elongated at the tip end thereof and separated into two branch lines extending for a predetermined length in opposite directions parallel with the input/output line 3, the two branch lines are then bent toward the input/output line 3 and then bent again toward the first line 41, and the tip ends of the two branch lines are grounded to a ground conductor. In addition, conducting switches 160*a* and 160*b* are disposed between the tip ends of the grounded branch lines and the first line 41. Configured in this way, the size of the first resonator 4 in the direction perpendicular to the input/output line 3 can be reduced while reducing the resonance frequency of the first resonator 4.

FIG. 15D shows an example in which the tip end of the first line 41 shown in FIG. 15A is separated into two branch lines, and one of the branch lines is an extension part of the first line 41 extending for a predetermined length as an extended first line 41E and is grounded at the tip end. Pairs of second lines $\mathbf{42}_7$ (a single reference numeral $\mathbf{42}_7$ represents a pair of second lines $\mathbf{42}_{a7}$ and $\mathbf{42}_{b7}$ for clarity of the drawing, and the same holds true with the remaining reference numerals), $\mathbf{42}_8$ and $\mathbf{42}_9$ are disposed on the opposite sides of the extended first line 41E, and short-circuiting switches $S_{16a}$, $S_{16b}$ and $S_{17a}$, $S_{17b}$ are connected to the outer ends of the second lines as with the second lines $\mathbf{42}_1$ and the like connected to the first line 41 in the vicinity of the input/output line 3. That is, another first resonator 4 having the same configuration is formed as an extension of the first resonator 4.

The other branch line constitutes a resonance line having the same configuration as the resonance line extended by the extended first line 41E and connected to the first line 41 via a switch 162, and the resonance line is composed of an extended first line $\mathbf{41}^{\#}$, pairs of second lines $\mathbf{42}_7^{\#}$, $\mathbf{42}_8^{\#}$ and $\mathbf{42}_9^{\#}$, and short-circuiting switches $S_{16a}^{\#}$, $S_{16b}^{\#}$ and $S_{17a}^{\#}$, $S_{17b}^{\#}$.

When the switch 150 is turned on, by the effect described above with reference to FIGS. 6C and 6D, the area of the resonance line in the region of high inductivity increases, so that the inductive reactance decreases, and the resonance frequency can be raised.

Once the resonance frequency is raised by turning the switching element 150 on, the resonance frequency can be finely changed by turning on and off the short-circuiting switches $S_{***}$ . The resonance lines can be configured to provide such an effect.

FIG. 15E shows an example in which the terminal of the terminal switch 7 that is grounded in FIG. 15A is connected to an additional line 61E, and the tip end of the additional line 61E is grounded. Configured in this way, the resonance frequency can be reduced by an amount corresponding to the length of the additional line 61E when the terminal switch 7 is turned on.

FIG. 15F shows an example in which the first line 61 of the second resonator 6 shown in FIG. 15A has a step impedance resonator structure described above with reference to FIG. 6C. Configured in this way, compared with the case where the first line 61 has a uniform width, the resonance frequency at the time when the terminal switch 7 is turned off can be increased, and the resonance frequency at the time when the terminal switch 7 is turned on can be reduced.

As described above, the first resonator 4 and the second resonator 6 can have different configurations. This arrangement is effective for eliminating the resonance frequency immediately next to the fundament frequency, such as 7.5 GHz in the case of a fundamental frequency of 2.5 GHz and 10 GHz in the case where a fundamental frequency of 5.0 GHz.

EXAMPLE 7

In the examples described above, the first resonator 4 is disposed on one side of the input/output line 3, and the second resonator 6 is disposed on the other side of the input/output line 3. However, the present invention is not limited to such an arrangement. In the case where the first resonator 4 is disposed on one side of the input/output line 3, and the second resonator 6 is disposed on the other side of the input/output line 3, the size of the variable resonator in the direction perpendicular to the input/output line 3 is large.

Figure 16:
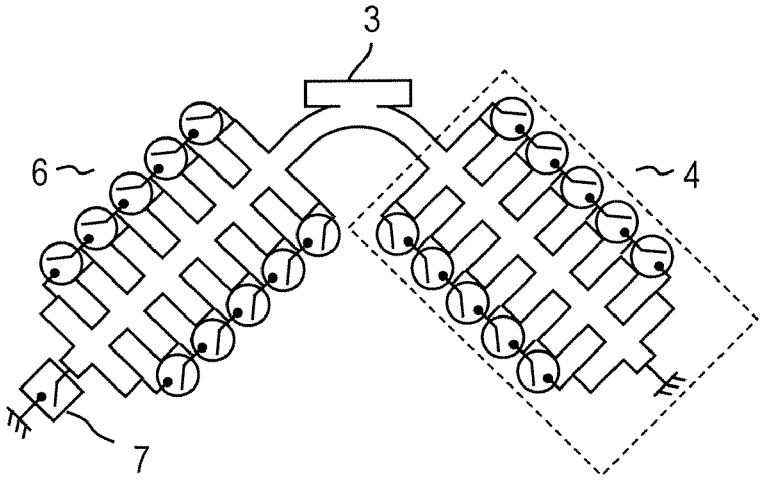
FIG. 16 shows an example 7 of the present invention.

As shown in FIG. 16, the variable resonator according to the present invention can operate the same way even if the first resonator 4 and the second resonator 6 are disposed on the same side of the input/output line 3. Thus, the variable resonator according to the present invention can be reduced in size in the direction perpendicular to the input/output line 3.

EXAMPLE 8

Figure 17A:
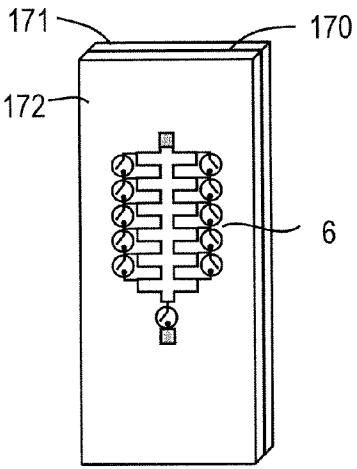
FIG. 17A is a perspective view of a variable resonator according to an example 8 of the present invention.
Figure 17B:
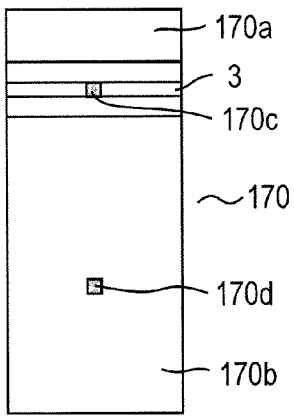
FIG. 17B is a diagram showing a pattern of a conductive film 170 formed on one surface of a dielectric substrate 171.
Figure 17C:
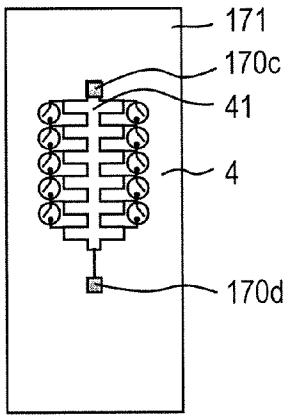
FIG. 17C is a diagram showing the other side of the dielectric substrate shown in FIG. 17B.
Figure 17D:
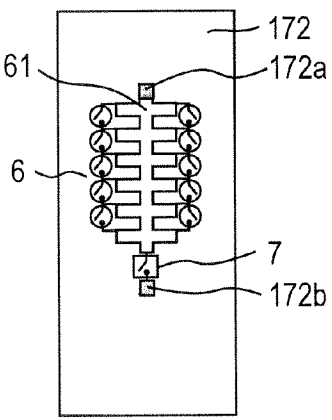
FIG. 17D is a diagram showing a surface of a dielectric substrate 172 opposite to the dielectric substrate 171.

FIGS. 17A to 17D show an example of a downsized variable resonator according to the present invention. According to this example, the first resonator 4 and the second resonator 6 of the variable resonator according to the present invention shown in FIG. 9A are formed on two separate dielectric substrates 171 and 172 at corresponding positions, respectively, and the ground conductor and the input/output line 3 are disposed between the two dielectric substrates 171 and 172. FIG. 17A is a perspective view showing the appearance of the variable resonator composed of a stack of the dielectric substrates 171 and 172. FIG. 17B shows a conductive film 170 that has a pattern of the input/output line 3 and the ground conductors 170*a* and 170*b* formed on one surface of the dielectric substrate 171. FIG. 17C shows the first resonator 4 formed on the surface of the dielectric substrate 171 opposite the dielectric substrate 172. FIG. 17D shows the second resonator 6 formed on the surface of the dielectric substrate 172 opposite the dielectric substrate 171.

The input/output line 3 formed by the conductive film 170 formed on the dielectric substrate 171 is a coplanar type. That is, the ground conductors 170*a* and 170*b* are formed on the opposite sides of the input/output line 3 on the same surface of the dielectric substrate 171. A via hole 170*c* is formed at about the middle of the length of the input/output line 3. Here, the conductive film 170 may be formed on the dielectric substrate 172 rather than on the dielectric substrate 171.

The first resonator 4 is formed on the surface of the dielectric substrate 171 opposite the dielectric substrate 172, and one end of the first line 41 of the first resonator 4 is connected to the input/output line 3 through the via hole 170*c*. The other end of the first line 41 is grounded to the ground conductor 170*b* through a via hole 170*d*.

The second resonator 6 is formed on the surface of the dielectric substrate 172 opposite the dielectric substrate 171, and one end of the first line 61 of the second resonator 6 is connected to the input/output line 3 through a via hole 172*a* at the position of the via hole 170*c*. The other end of the first line 61 is grounded to the ground conductor 170*b* through the terminal switch 7 and a via hole 172*b*.

By overlaying the first resonator 4 and the second resonator 6 on one another with the dielectric substrates 171 and 172 interposed therebetween, the size of the variable resonator in the direction perpendicular to the input/output line 3 can be reduced.

Figure 18A:
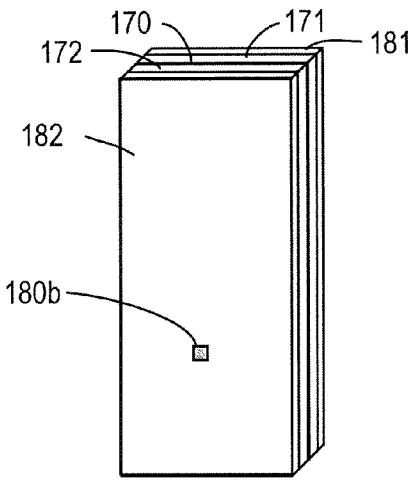
FIG. 18A is a perspective view showing a variable resonator according to an example of the present invention in which shielding ground conductors 181 and 182 are added to the variable resonator shown in FIG. 17.
Figure 18G:
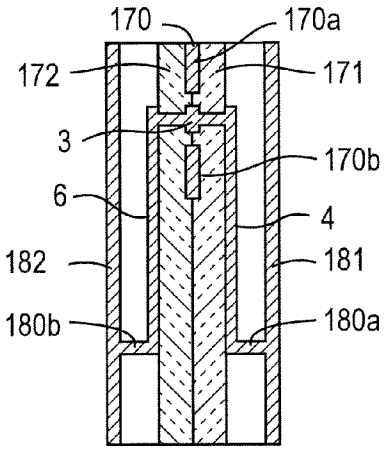
FIG. 18G is a longitudinal cross-sectional view of the variable resonator shown in FIG. 18A taken along the centerline thereof.
Figure 18E:
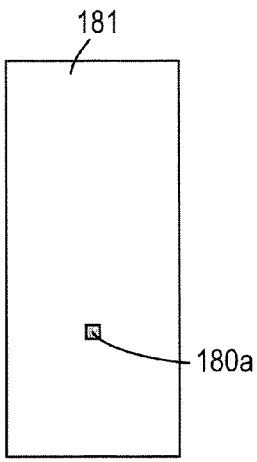
FIG. 18E is a diagram showing a surface of the shielding ground conductor 181 opposite to the dielectric substrate 171.
Figure 18C:
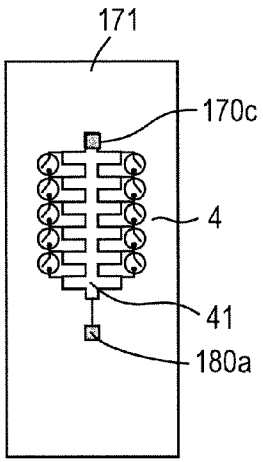
FIG. 18C is a diagram showing the other side of the dielectric substrate shown in FIG. 18B.
Figure 18B:
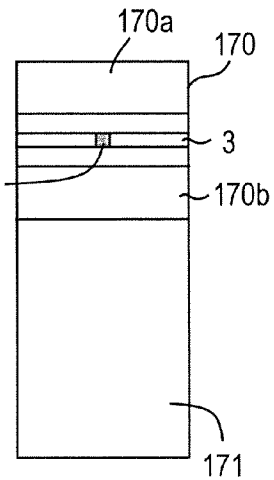
FIG. 18B is a diagram showing a pattern of a conductive film 170 formed on one surface of a dielectric substrate 171.
Figure 18D:
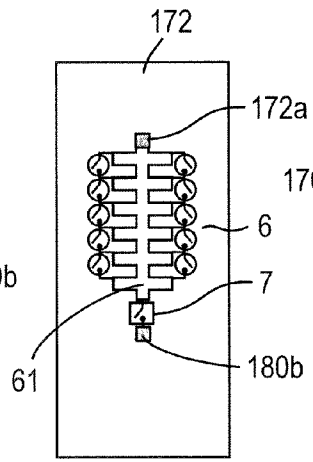
FIG. 18D is a diagram showing a surface of a dielectric substrate 172 opposite to the dielectric substrate 171.
Figure 18F:
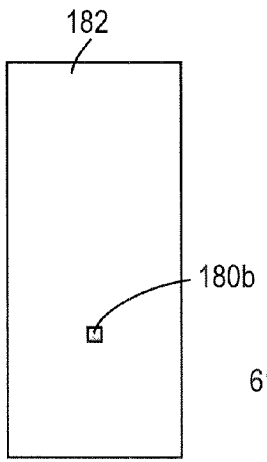
FIG. 18F is a diagram showing a surface of the shielding ground conductor 182 opposite to the dielectric substrate 172.
Figures 19A, 19B, 19C, 19D, 19E, 19F, 19G:
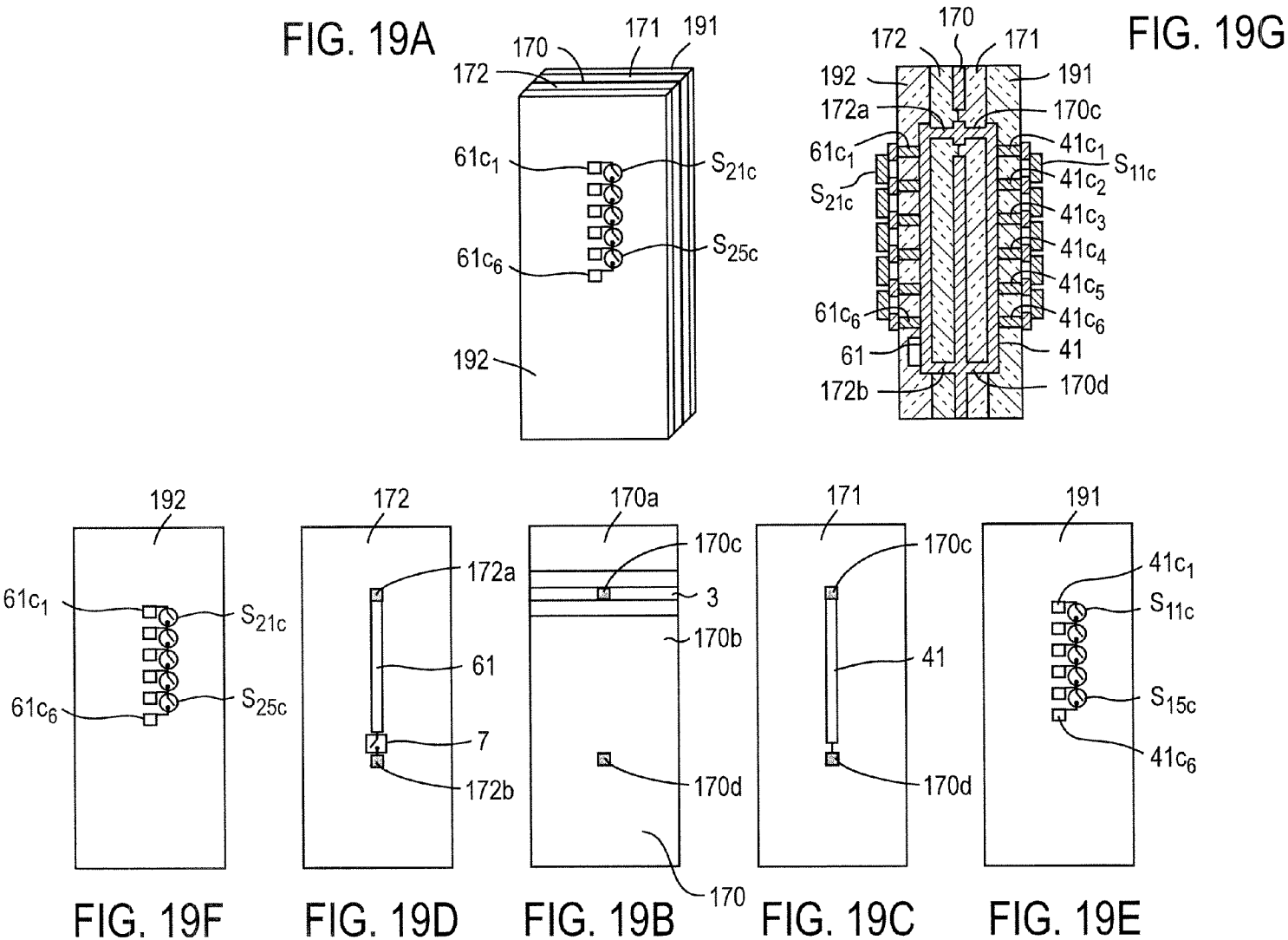
FIG. 19A is a perspective view of a variable resonator completed by overlaying four dielectric substrates 171, 172, 191 and 192.
FIG. 19B is a diagram showing a pattern of a conductive film 170 formed on one surface of the dielectric substrate 171.
FIG. 19C is a diagram showing the other side of the dielectric substrate shown in FIG. 19B.
FIG. 19D is a diagram showing a surface of the dielectric substrate 172 opposite to the conductive film 170.
FIG. 19E is a diagram showing a surface of the dielectric substrate 171 opposite from the dielectric substrate 172.
FIG. 19F is a diagram showing a surface of the dielectric substrate 192 opposite from the dielectric substrate 172.
FIG. 19G is a longitudinal cross-sectional view of the variable resonator shown in FIG. 19A taken along the centerline thereof.

FIGS. 18A to 18G show an example in which shielding ground conductors 181 and 182 opposed to each other are disposed at the outer sides of the first resonator 4 and the second resonator 6 in the example shown in FIGS. 17A to 17D, respectively. The ground conductors 170*a* and 170*b* constituted by the conductive film 170 are formed only in the vicinity of the input/output line 3 and form a coplanar line structure in combination with the input/output line 3. FIGS. 18A, 18B and 18C correspond to FIGS. 17A, 17B and 17C, respectively. FIG. 18E shows the side of the shielding ground conductor 181 opposite from the dielectric substrate 171, FIG. 18F shows the side of the shielding ground conductor 182 opposite from the dielectric substrate 172, and FIG. 18G is a longitudinal cross-sectional view of the variable resonator shown in FIG. 18A taken along the centerline thereof.

One end of the first resonator 4 is connected to the shielding ground conductor 181 disposed opposite thereto via a conductive column 180*a*. One end of the second resonator 6 is connected to the shielding ground conductor 182 disposed opposite thereto via a conductive column 180*b*.

With such a configuration, the conductive film 170 interposed between the resonators 4 and 6 having a microstrip line structure does not need to be formed over the entire surface of the dielectric substrate 171 (or 172), and the area of the ground conductor 170*b* is reduced as shown in FIG. 18B. A desired circuit may be formed in the region on the dielectric substrate 171 which becomes available by partially removing the ground conductor 170*b* shown in FIG. 17B. In addition, since the first resonator 4 and the second resonator 6 are not exposed, the noise immunity can be improved. In summary, the ground conductors 181 and 182 serve as shielding plates, and accordingly, the level of radiated noise and incoming noise can be reduced.

EXAMPLE 9

FIGS. 19A to 19G show an example in which the variable resonator according to the present invention shown in FIGS. 17A to 17D is further downsized. In this example, the pairs of second lines (corresponding to the second lines $\mathbf{42}_{a1}$, $\mathbf{42}_{b1}$ to $\mathbf{42}_{a6}$, $\mathbf{42}_{b6}$ and $\mathbf{62}_{a1}$, $\mathbf{62}_{b1}$ to $\mathbf{62}_{b6}$, $\mathbf{62}_{b6}$) formed on the same surfaces of the dielectric substrates 171 and 172 as the first lines 41 and 61 are removed, dielectric substrates 191 and 192 are further disposed at the outer sides of the dielectric substrates 171 and 172 disposed opposite to each other, respectively, and second lines $\mathbf{41}_{c1}$ to $\mathbf{41}_{c6}$ and $\mathbf{61}_{c1}$ to $\mathbf{61}_{c6}$ are formed that extend from the first lines 41 and 61 on the dielectric substrates 171 and 172 and penetrate the width of the dielectric substrates 191 and 192, respectively, thereby reducing the size of the variable resonator in the direction of the input/output line 3. FIGS. 19A to 19D correspond to FIGS. 17A to 17D.

The first line 41 of the first resonator 4 is formed on one of the opposed surfaces of the dielectric substrates 171 and 191 (on the surface of the dielectric substrate 171 in this example). One end of the first line 41 is connected to the input/output line 3 through the via hole 170*c* in the dielectric substrate 171, and the other end of the first line 41 is connected to the ground conductor 170*b* through the via hole 170*d* in the dielectric substrate 171. A plurality of interlayer connecting conductors $\mathbf{41}_{c1}$ to $\mathbf{41}_{c6}$ in contact with the first line 41 of the first resonator 4 are arranged at regular intervals along the length of the first line 41 and penetrate the dielectric substrate 191. Short-circuiting switches $S_{11c}$ to $S_{15c}$ capable of interconnecting the adjacent interlayer connecting conductors are formed on the outer surface of the dielectric substrate 191. That is, the interlayer connecting conductors formed along the first line 41 constitute the second lines of the first resonator.

Similarly, the first line 61 of the second resonator 6 is formed on one of the opposed surfaces of the dielectric substrates 172 and 192 (on the surface of the dielectric substrate 172 in this example). One end of the first line 61 is connected to the input/output line 3 through the via hole 172*a* in the dielectric substrate 172, and the other end of the first line 61 is connected to the ground conductor 170*b* through the terminal switch 7 and the via hole 172*b* in the dielectric substrate 172. A plurality of interlayer connecting conductors $\mathbf{61}_{c1}$ to $\mathbf{61}_{c6}$ in contact with the first line 61 of the second resonator 6 are arranged at regular intervals along the length of the first line 61 and penetrate the dielectric substrate 192. Short-circuiting switches $S_{21c}$ to $S_{26c}$ capable of interconnecting the adjacent interlayer connecting conductors are formed on the outer surface of the dielectric substrate 192. The interlayer connecting conductors constitute the second lines of the second resonator.

With such a configuration, since the second lines are formed perpendicularly to the conductive film 170, the size of the variable resonator in the direction of the input/output line 3 can be reduced.

APPLICATION EXAMPLES

Figure 20:
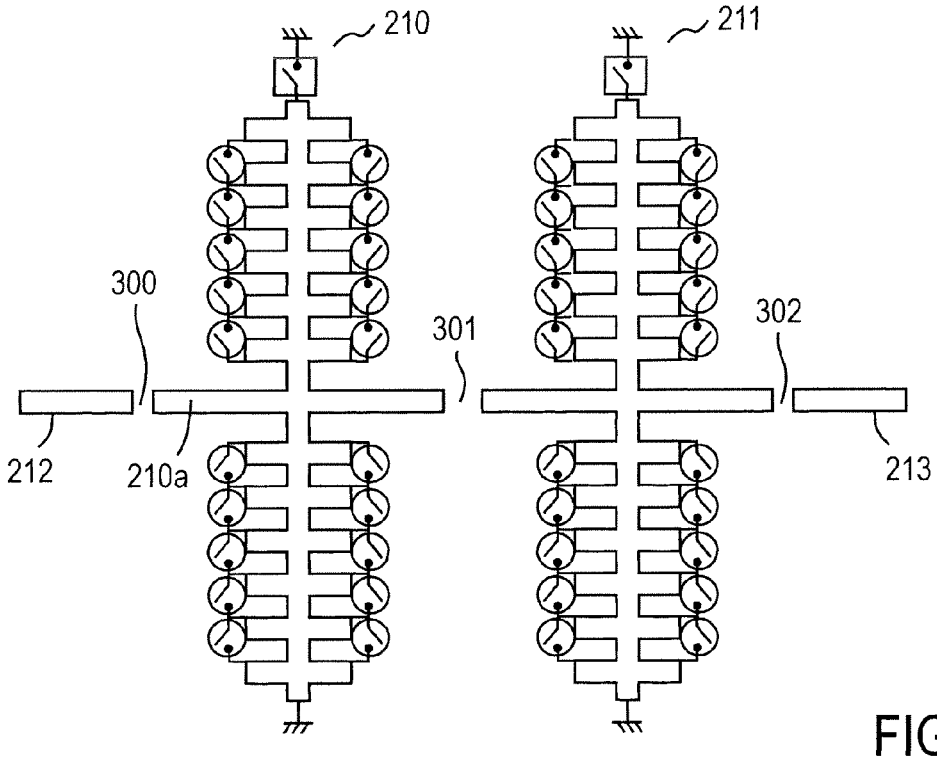
FIG. 20 shows an application example in which two resonators according to the present invention are connected in series to each other by electric field coupling.
Figure 21:
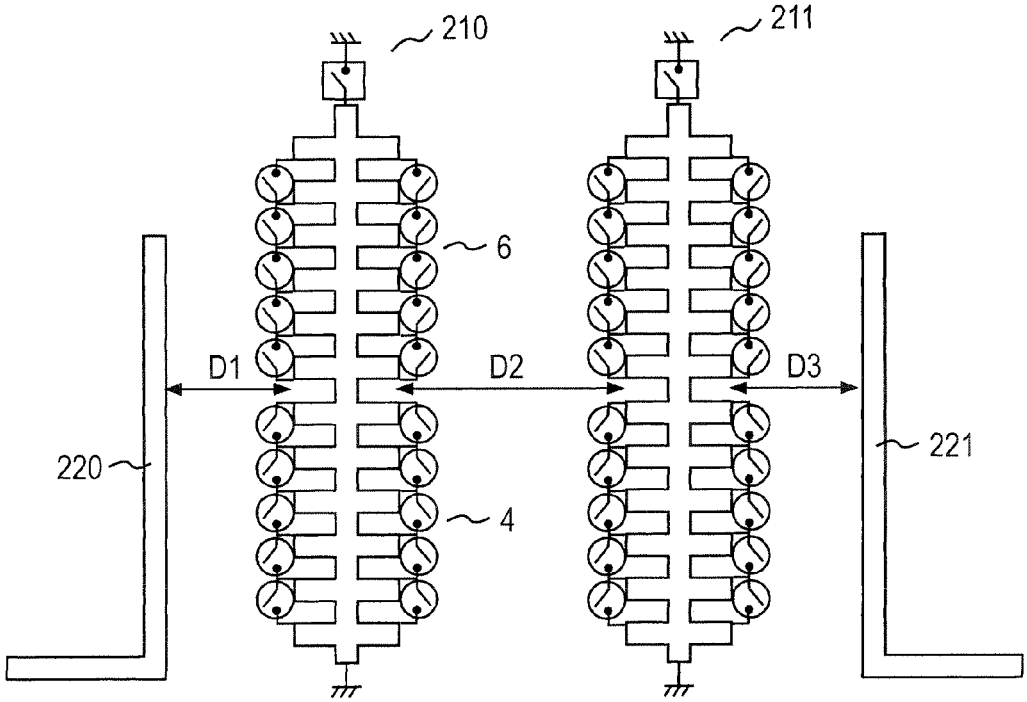
FIG. 21 shows an application example in which two resonators according to the present invention are connected in series to each other by magnetic field coupling.

FIGS. 20 and 21 show application examples of the variable resonator according to the present invention. FIG. 20 shows an application example in which two variable resonators 210 and 211 according to the present invention are connected in series to each other by electric field coupling. An input/output port 212 and an input/output line 210*a* of the first-stage variable resonator 210 have equal line widths and are opposed to each other with a gap 300 therebetween. The first-stage variable resonator 210 and the second-stage variable resonator 211 are also opposed to each other with a gap 301 therebetween, and the second-stage variable resonator 211 and an input/output port 213 are also opposed to each other with a gap 302 therebetween. The lengths of the gaps 300 to 302 and the shapes of the parts opposed to each other are designed according to the degree of electric field coupling.

FIG. 21 shows the same arrangement as that shown in FIG. 20 except that the variable resonators are connected in series to each other by magnetic field coupling. An input/output port 220 is disposed along the first resonator 4 and the second resonator 6 of the variable resonator 210 at a distance D1 therefrom. The variable resonators 210 and 211 are disposed in parallel with each other at a distance D2. An input/output port 221 having the same shape as the input/output port 220 is disposed at a distance D3 from the variable resonator 211. The input/output port 220, the variable resonators 210 and 211 and the input/output port 211 are coupled to each other by a magnetic field. In this embodiment the connecting point between the first and second resonators 4 and 6 can be a portion of the line between any adjacent pairs of the second lines, which portion can be regarded the input/output line.

As described above, the variable resonator according to the present invention has the first resonator and the second resonator connected in parallel to the input/output line and can largely change the resonance frequency by grounding the end of the second resonator opposite to the end connected to the input/output line via the switch when changing the resonance frequency is desired. According to the present invention, the first and second resonators are connected in parallel, so that the effect of the resistance of the switch can be reduced compared with the prior art. Thus, the variable resonator can have a wide range of variation of frequency and a low loss.

Furthermore, there can be provided a variable resonator capable of finely changing the resonance frequency in the vicinity of the largely changed resonance frequency described above by forming the resonance line into various shapes and finely changing the line length.

What is claimed is:

1. A variable resonator, comprising:

a dielectric substrate;

an input/output line formed on the dielectric substrate;

a first resonator that has one end connected directly to said input/output line and another end directly grounded; and a second resonator that has one end connected to the point of connection of said one end of said first resonator to said input/output line and another end grounded via a terminal switch, wherein the first and second resonators are configured so that a combined admittance of the first and second resonators seen from the point of connection is zero at both a predetermined first frequency when the terminal switch is ON and a predetermined second frequency different from the first frequency when the terminal switch is OFF.

2. A variable resonator according to claim 1, wherein a part of said second resonator close to the one end one end has a line width different from that of a part thereof close to the another end to form a step impedance resonator.

3. A variable resonator according to claim 1, wherein said one end of said second resonator is connected to the point of connection of said one end of said first resonator to said input/output line via a shut-off switch.

4. A variable resonator according to any one of claims 1 to 3, wherein each of said first and second resonators is composed of a first line and a plurality of second lines connected to said first line and arranged at intervals along the length of said first line.

5. A variable resonator according to claim 4, further comprising short-circuiting switches capable of interconnecting free ends of adjacent two of said second lines.

6. A variable resonator according to claim 5, further comprising a grounding switch capable of grounding the free end of at least one of said second lines.

7. A variable resonator according to claim 4, wherein said dielectric substrate comprises a first dielectric substrate and a second dielectric substrate opposed to each other, said input/output line is constituted by a conductive film and is formed as a coplanar line on one of the opposed surfaces of said first and second dielectric substrates, said first and second resonators are formed on the outer surfaces of said first and second dielectric substrates, respectively, and said first and second resonators are connected to said coplanar line via conductors penetrating said first and second dielectric substrates, respectively.

8. A variable resonator according to claim 7, further comprising third and fourth dielectric substrates opposed to the outer surfaces of said first and second dielectric substrates, respectively, wherein said plurality of second lines of said first and second resonators are formed to extend from said first line and penetrate a width of said third and fourth dielectric substrates, respectively, and the variable resonator further comprises a plurality of short-circuiting switches capable of short-circuiting adjacent two of the ends of said plurality of second lines having penetrated said third and fourth dielectric substrates.

9. A variable resonator according to claim 7, further comprising first and second shielding ground conductors opposed to said first and second dielectric substrates at a distance to cover at least regions of said first and second dielectric substrates in which said first and second resonators are formed, respectively.

10. A variable resonator according to claim 4, wherein said plurality of second lines are formed to intersect with said first line.

11. A variable resonator according to claim 10, further comprising a plurality of short-circuiting switches that short-circuit adjacent two of the tip ends of said plurality of second lines of said first and second resonators.

* * * * *